US009802429B2

(12) United States Patent
Kawajiri et al.

(10) Patent No.: US 9,802,429 B2
(45) Date of Patent: Oct. 31, 2017

(54) MEDIA CONVEYANCE DEVICE, PRINTER, AND CONTROL METHOD OF A MEDIA CONVEYANCE DEVICE

(71) Applicant: Seiko Epson Corporation, Tokyo (JP)

(72) Inventors: Masahiro Kawajiri, Shiojiri (JP); Nobuhiro Inoue, Matsumoto (JP); Norio Horaguchi, Minowa-Machi (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/403,948

(22) Filed: Jan. 11, 2017

(65) Prior Publication Data

US 2017/0197442 A1 Jul. 13, 2017

(30) Foreign Application Priority Data

Jan. 13, 2016 (JP) ..... 2016-004169
Nov. 2, 2016 (JP) ..... 2016-214912

(51) Int. Cl.

| | |
|---|---|
| ***B41J 15/00*** | (2006.01) |
| ***B41J 11/00*** | (2006.01) |
| ***B41J 15/16*** | (2006.01) |
| ***B41J 2/01*** | (2006.01) |
| ***B41J 15/04*** | (2006.01) |

(Continued)

(52) U.S. Cl.

CPC ..... *B41J 15/165* (2013.01); *B41J 2/01* (2013.01); *B41J 11/0095* (2013.01); *B41J 15/048* (2013.01); *B65H 16/026* (2013.01); *B65H 20/02* (2013.01); *B41J 15/04* (2013.01); *B65H 2553/41* (2013.01)

(58) Field of Classification Search

CPC ..... B41J 3/60; B41J 2/01; B41J 13/009; B41J 3/543; B41J 15/048; B41J 25/001; B65H 2301/132; B65H 2301/133

See application file for complete search history.

(56) References Cited

U.S. PATENT DOCUMENTS 6,447,186 B1 * 9/2002 Oguchi ..... B41J 11/0095 400/582
7,150,573 B2 12/2006 Cummins et al.
8,844,176 B2 * 9/2014 Hiraoka ..... D06F 61/02 38/52

FOREIGN PATENT DOCUMENTS

JP 05-232599 A 9/1993
JP 10-035966 A 2/1998
JP 2004-291516 A 10/2004

(Continued)

*Primary Examiner* — Thinh H Nguyen

(74) *Attorney, Agent, or Firm* — Nutter McClennen & Fish LLP; John J. Penny, Jr.

(57) ABSTRACT

A control method of a media conveyance device enables accurately detecting media slack by a detection mechanism with multiple emitters and multiple photodetectors disposed opposite the emitters. A printer (media conveyance device) has a controller that controls a delivery mechanism, a conveyance mechanism that conveys media, a delivery mechanism, and a conveyance mechanism, and controls conveying roll paper; a first detector including a first emitter and first photodetector; and a second detector including a second emitter and second photodetector. When driving the conveyance mechanism, the controller selectively controls the first emitter and first photodetector to emit, and drives a spindle based on signal output from the first detector when first emitter emits, and signal output from the second detector when second emitter emits.

11 Claims, 22 Drawing Sheets

(51) Int. Cl.
*B65H 16/02* (2006.01)
*B65H 20/02* (2006.01)

(56) References Cited

FOREIGN PATENT DOCUMENTS

| | | | |
|---|---|---|---|
| JP | 2013-063821 | A | 4/2013 |
| JP | 2014-141339 | A | 8/2014 |

* cited by examiner

MEDIA CONVEYANCE DEVICE, PRINTER, AND CONTROL METHOD OF A MEDIA CONVEYANCE DEVICE

CROSS REFERENCE TO RELATED APPLICATION

The present application claims priority under 35 U.S.C. §119 to Japanese Application Nos. 2016-004169 and 2016-214912, filed on Jan. 13, 2016 and Nov. 2, 2016, respectively.

BACKGROUND

1. Technical Field

The present invention relates to a control method of a media conveyance device that conveys a continuous medium with slack in the conveyance path of the medium. The invention also relates to a media conveyance device and a printer that convey media by the control method.

2. Related Art

A media conveyance device that conveys continuous media is described in JP-A-2014-141339. The media conveyance device in JP-A-2014-141339 has a delivery mechanism that delivers media; a conveyance mechanism that conveys the media delivered from the delivery mechanism; and a slack chamber (space) between the delivery mechanism and conveyance mechanism. The media conveyance device has a detection mechanism that detects the portion of the media hanging slack in the slack chamber, and a conveyance controller that controls driving the delivery mechanism and conveyance mechanism.

The detection mechanism has a first emitter that emits a first detection beam; a second emitter located below the first emitter and emitting a second detection beam; a third emitter located below the second emitter and emitting a third detection beam; and a fourth emitter located below the third emitter and emitting a fourth detection beam. The detection mechanism also has a first photodetector able to detect a first detection beam that past through the slack chamber; a second photodetector located below the first photodetector and able to detect a second detection beam that past through the slack chamber; a third photodetector located below the second photodetector and able to detect a third detection beam that past through the slack chamber; and a fourth photodetector located below the third photodetector and able to detect a fourth detection beam that past through the slack chamber. The first emitter, second emitter, third emitter and fourth emitter are arrayed vertically at a uniform spacing. The first photodetector, second photodetector, third photodetector and third photodetector are arrayed vertically at a uniform interval. The gaps between the emitters, and the gaps between the photodetectors, are the same.

When driving the conveyance mechanism and conveying the media, the conveyance controller drives the delivery mechanism based on output from the photodetectors of the detection mechanism. More specifically, based on whether or not the detection beam was detected by each photodetector (whether or not part of the media is blocking the detection beam), the conveyance controller can determine how much slack there is in the slack chamber. When the amount of slack gets too small, the conveyance controller drives the delivery mechanism to deliver media so that the media goes slack inside the slack chamber.

If the gap between the emitters and the gap between the photodetectors in the detection mechanism described in JP-A-2014-141339 is small, the amount of slack in the media can be detected with good precision. If the amount of slack in the media is precisely detected, the media can be reliably conveyed with slack between the delivery mechanism and conveyance mechanism, and excessive tension working on the medium can be prevented. As a result, the medium can be conveyed with good precision.

However, because the detection beam emitted from the emitters is diffuse light, if the gap between the emitters and the gap between the photodetectors is small, the second photodetector may detect the first detection beam, the first photodetector and the third photodetector may be detect the second detection beam, and detection beam detection errors may occur. If a detection beam is wrongly detected, the amount of slack in the media cannot be accurately detected.

An objective of the invention is therefore to provide a control method of a media conveyance device able to accurately detect media slack by a detection mechanism having multiple emitters and multiple photodetectors located opposite the emitters. A further objective is to provide a media conveyance mechanism and printer configured to convey media by the control method.

SUMMARY

To achieve the foregoing objective, a media conveyance device according to the invention includes a paper roll rotating mechanism having a spindle to support a paper roll, and configured to drive the spindle and rotate the paper roll; a conveyance mechanism configured to convey media delivered from the paper roll; a controller configured to control the paper roll rotating mechanism and the conveyance mechanism, and convey media delivered from the paper roll; a first detector including a first emitter and first photodetector disposed vertically below the spindle, and outputting to the controller a signal based on the amount of light detected by the first photodetector; and a second detector including a second emitter disposed vertically below the first emitter and a second photodetector disposed vertically below the first photodetector, and outputting to the controller a signal based on the amount of light detected by the second photodetector. The controller selectively drives the first emitter and second emitter when driving the conveyance mechanism, and drives the spindle based on signal output from the first detector when the first emitter emits, and signal output from the second detector when the second emitter emits.

The first emitter and second emitter in this configuration emit exclusively. Therefore, the detection beam the first photodetector detects when the first emitter emits is the first detection beam; and the detection beam the second photodetector detects when the second emitter emits is the second detection beam. This configuration can prevent mistaking detection of the second detection beam by the first photodetector as detection of the first detection beam. Mistaking detection of the first detection beam by the second photodetector as detection of the second detection beam can also be prevented. Because the amount of slack in the media can therefore be accurately detected, the media can be always conveyed with desirable slack. Excessive tension working on the media when the media is conveyed can therefore be prevented, and the media can be precisely conveyed. Furthermore, because slack detection errors can be prevented even if the first photodetector is disposed to a position where the second detection beam from the second emitter can be detected, and the second photodetector is disposed to a position where the first detection beam from the first emitter can be detected, there is no need to precisely align the optical axes of the detection beams emitted by the emitters to prevent detection errors. Device assembly is therefore simple.

Preferably in a media conveyance device according to another aspect of the invention, when the media is conveyed by the conveyance mechanism in the direction from the paper roll to the conveyance mechanism, the controller, based on signal output from the second detector, determines whether or not to drive the spindle in a first direction of rotation delivering the media; increases the speed of the spindle in the first direction of rotation when slack hanging down from the paper roll is determined less than a first threshold based on the signal output from the first detector when the spindle is turning in the first direction of rotation from the paper roll based on the decision; and stops rotation of the spindle when slack hanging down from the paper roll is determined greater than a second threshold, at which the amount of slack in the media is greater than the first threshold, based on the signal output from the second detector when the spindle is turning in the first direction of rotation from the paper roll based on the decision.

For example, of the two detectors, when a signal is output from the upper first detector, the media is not blocking the first detection beam, the first photodetector detects the first detection beam from the first emitter, and media slack is not detected. Therefore, in this case, based on signal output from the first detector, if the spindle rotating in the first direction of rotation is turned at high speed to deliver media, slack grows in the media, and tension on the conveyed media can be prevented. Furthermore, if a signal is not output from the lower second detector, the media is blocking the second detection beam, and slack in the conveyed media is increasing. Therefore, in this case, if the spindle turning in the first direction of rotation is stopped based on the signal output from the second detector, media slack can be returned to a desirable amount.

Further preferably in a media conveyance device according to another aspect of the invention, when the media is conveyed by the conveyance mechanism in the direction from the conveyance mechanism to the paper roll, the controller, based on the signal output from the second detector, determines whether or not to rotate the spindle in a second direction of rotation rewinding the media; and when the spindle is rotating in the second direction of rotation based on the decision, and the slack hanging down from the paper roll is determined less than a first threshold based on the signal output from the first detector, the controller stops rotation of the spindle in the second direction of rotation.

Even when the media is conveyed in the direction from the conveyance mechanism to the paper roll, if a signal is output from the first detector, the media is not blocking the first detection beam, and media slack is not detected. Therefore, if rotation of the spindle turning in the direction rewinding the media is stopped in this case, slack can be created in the media.

Further preferably in a media conveyance device according to another aspect of the invention, the controller drives the conveyance mechanism to convey the media a specific amount in the direction from the paper roll to the conveyance mechanism, and then stops driving the conveyance mechanism; and drives the spindle in a second direction of rotation, which is opposite the first direction of rotation, until slack in the media is less than the second threshold based on signal output from the second detector.

The conveyance mechanism being stopped after conveying the media a specific amount happens when, for example, the media is nipped by a roller pair in the conveyance mechanism. In this case, if the spindle is turned in the second direction of rotation until media slack goes below the second threshold, the amount of slack in the media, which was great when the media was nipped, can be adjusted desirably.

Further preferably, a media conveyance device according to another aspect of the invention also has a third detector including a third emitter located vertically between the first emitter and second emitter, and a third photodetector located vertically between the first photodetector and second photodetector. When the media is conveyed by the conveyance mechanism in the direction from the paper roll to the conveyance mechanism, the controller controls rotation of the spindle in the first direction of rotation based on signal output from the first detector and signal output from the second detector; and when the media is conveyed by the conveyance mechanism in the direction from the conveyance mechanism to the paper roll, the controller controls rotation of the spindle in the second direction of rotation, which is opposite the first direction of rotation, based on signal output from the third detector.

Compared with controlling spindle rotation based only on the first detector and second detector, this configuration enables controlling the amount of slack in the media more appropriately.

Another aspect of the invention is a printer including the media conveyance device described above; a printhead; and a conveyance path passing the printing position of the printhead; the media conveyance device conveying the media through the conveyance path.

This configuration prevents applying excessive to the conveyed media. As a result, because media is conveyed precisely through the conveyance path, print quality can be maintained.

Another aspect of the invention is a control method of a media conveyance device, the media conveyance device including a paper roll rotating mechanism having a spindle to support a paper roll, and configured to drive the spindle and rotate the paper roll; a conveyance mechanism configured to convey media delivered from the paper roll; and a first detector including a first emitter and first photodetector disposed vertically below the spindle, and outputting a signal based on the amount of light detected by the first photodetector; and a second detector including a second emitter disposed vertically below the first emitter and a second photodetector disposed vertically below the first photodetector, and outputting a signal based on the amount of light detected by the second photodetector. The control method includes: selectively driving the first emitter and second emitter while driving the conveyance mechanism and conveying the media; and driving the spindle based on signal output from the first detector when the first emitter emits, and signal output from the second detector when the second emitter emits.

The first emitter and second emitter in this configuration emit exclusively. Therefore, the detection beam the first photodetector detects when the first emitter emits is the first detection beam; and the detection beam the second photodetector detects when the second emitter emits is the second detection beam. This configuration can prevent mistaking detection of the second detection beam by the first photodetector as detection of the first detection beam. Mistaking detection of the first detection beam by the second photodetector as detection of the second detection beam can also be prevented. Because the amount of slack in the media can therefore be accurately detected, the media can be always conveyed with desirable slack. Excessive tension working on the media when the media is conveyed can therefore be prevented, and the media can be precisely conveyed. Furthermore, because slack detection errors can be prevented even if the first photodetector is disposed to a position where the second detection beam from the second emitter can be detected, and the second photodetector is disposed to a position where the first detection beam from the first emitter can be detected, there is no need to precisely align the optical axes of the detection beams emitted by the emitters to prevent detection errors. Device assembly is therefore simple.

Preferably a control method of a media conveyance device according to another aspect of the invention also includes: driving the conveyance mechanism and conveying the media in the direction from the paper roll to the conveyance mechanism; determining, based on signal output from the second detector, whether or not to drive the spindle in a first direction of rotation delivering the media; and while driving the spindle in the first direction of rotation based on the decision, increasing the speed of the spindle in the first direction of rotation when slack hanging down from the paper roll is determined less than a first threshold based on the signal output from the first detector, and stopping rotation of the spindle when slack hanging down from the paper roll is determined, based on the signal output from the second detector, greater than a second threshold, at which the amount of slack in the media is greater than the first threshold.

For example, when a signal is output from the first detector, media slack is not detected. Therefore, in this case, based on signal output from the first detector, if the spindle rotating in the first direction of rotation is turned at high speed to deliver media, slack grows in the media, and tension on the conveyed media can be prevented. Furthermore, if a signal is not output from the lower second detector, slack in the conveyed media is increasing. Therefore, in this case, if the spindle turning in the first direction of rotation is stopped based on the signal output from the second detector, media slack can be returned to a desirable amount.

The control method in another aspect of the invention drives the conveyance mechanism to convey the media in the direction from the paper roll to the conveyance mechanism; determines, based on signal output from the second detector, whether or not to turn the spindle in a second direction of rotation rewinding the media; and if, while turning the spindle in the second direction of rotation based on the decision, the slack hanging down from the paper roll is determined, based on signal output from the first detector, below the first threshold, stops rotation of the spindle in the second direction of rotation.

Media slack is not detected if a signal is output from the first detector, even while the media is conveyed in the direction from the conveyance mechanism to the paper roll. Therefore, if spindle rotation in the direction rewinding the media is stopped in this case, slack can be created in the media.

A control method of a media conveyance device according to another aspect of the invention preferably also includes: driving the conveyance mechanism to convey the media a specific amount in the direction from the paper roll to the conveyance mechanism, and then stopping driving the conveyance mechanism; and driving the spindle in a second direction of rotation, which is opposite the first direction of rotation, until slack in the media is less than the second threshold based on signal output from the second detector.

The conveyance mechanism being stopped after conveying the media a specific amount happens when, for example, the media is nipped by a roller pair in the conveyance mechanism. In this case, if the spindle is turned in the second direction of rotation until media slack goes below the second threshold, the amount of slack in the media, which was great when the media was nipped, can be adjusted desirably.

In a control method of a media conveyance device according to another aspect of the invention, the media conveyance device also has a third detector including a third emitter located vertically between the first emitter and second emitter, and a third photodetector located vertically between the first photodetector and second photodetector, and the control method further includes: driving the conveyance mechanism and conveying the media in the direction from the paper roll to the conveyance mechanism; and controlling rotation of the spindle in the first direction of rotation based on signal output from the first detector and signal output from the second detector; and based on signal output from the third detector, controlling rotation of the spindle in the second direction of rotation, which is opposite the first direction of rotation.

Because the amount of slack in the media can be more accurately acquired and spindle drive controlled, the amount of slack in the media when the media is conveyed can be more desirably maintained.

Other objects and attainments together with a fuller understanding of the invention will become apparent and appreciated by referring to the following description and claims taken in conjunction with the accompanying drawings.

DESCRIPTION OF EMBODIMENTS

Preferred embodiments of the present invention are described below with reference to the accompanying figures.

Embodiment 1

General Configuration

Figure 1:
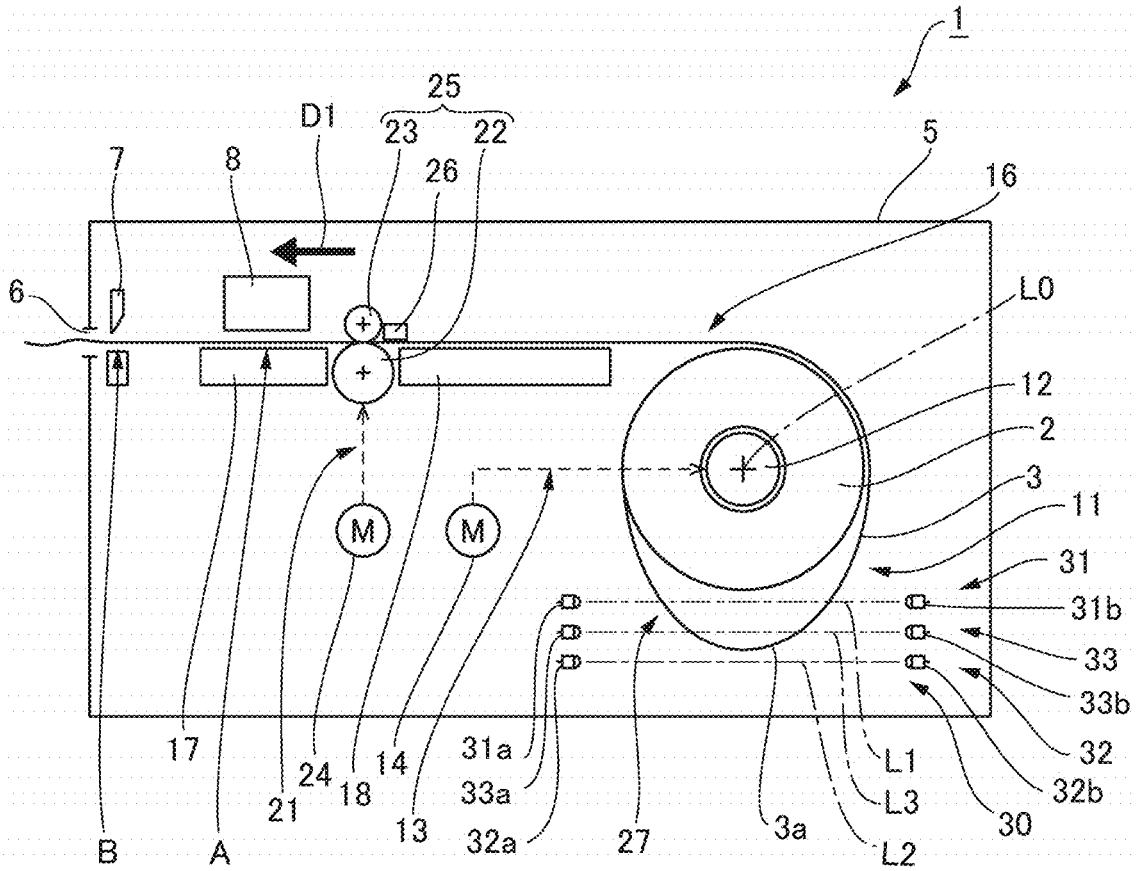
FIG. 1 illustrates the configuration of a printer according to a first embodiment of the invention.

FIG. 1 illustrates the configuration of a printer according to a first embodiment of the invention. FIG. 1 shows the printer of the embodiment from the side. As shown in FIG. 1, the printer (printing device, media conveyance device) 1 in this example is a roll paper printer that prints on continuous recording paper 3 delivered from a paper roll 2. The printer 1 has a box-like case 5. In the front of the case 5 is a paper exit 6. Inside the case 5 on the inside side of the paper exit 6 is an automatic cutter 7. Behind the automatic cutter 7 is a printhead 8. The printhead 8 is an inkjet head.

At the inside back of the case 5 is a roll paper compartment 11 where a paper roll 2 is held. The roll paper compartment 11 has a roll paper drive spindle 12 on which the core in the center of the paper roll 2 is mounted. The roll paper drive spindle 12 is driven by a spindle drive motor 14. The roll paper drive spindle 12 and spindle drive motor 14 embody a delivery mechanism 13 (paper roll rotating mechanism) that delivers recording paper 3 from the paper roll 2.

Also inside the case 5 is configured a paper conveyance path 16 (conveyance path) going from the roll paper compartment 11, past the printing position A of the printhead 8, and the cutting position B of the automatic cutter 7, to the paper exit 6. The printing position A is defined by the ink nozzle face of the printhead 8 and a platen 17 disposed at an opposing position. The paper conveyance path 16 is defined by the platen 17, and a lower paper guide 18 located behind the platen 17. The platen 17 and lower paper guide 18 are above the roll paper drive spindle 12. The platen 17 and lower paper guide 18 are also in front of the roll paper drive spindle 12.

The printer 1 has a conveyance mechanism 21 that conveys recording paper 3 through the paper conveyance path 16. The conveyance mechanism 21 includes a conveyance roller 22, and a pressure roller 23 that is pressed from above against the conveyance roller 22 and follows the conveyance roller 22. The conveyance mechanism 21 also has a conveyance motor 24 as the drive source that drives the conveyance roller 22. The conveyance roller 22 is between the platen 17 and lower paper guide 18. The conveyance mechanism 21 holds and conveys the recording paper 3 between the conveyance roller 22 and pressure roller 23. At a position proximal to the conveyance roller pair 25, which includes the conveyance roller 22 and pressure roller 23, is disposed a nip sensor 26, which detects if the leading end of the recording paper 3 is at the nip position N where it can be nipped by the conveyance roller pair 25. The nip sensor 26 mechanically or optically detects the leading end of the recording paper 3. The nip sensor 26 in this example is a mechanical sensor that, by contacting the recording paper 3, detects if the leading end of the recording paper 3 is at the nip position N.

Below the roll paper compartment 11 in the case 5 is a slack chamber 27, which holds the slack portion 3*a* of the recording paper 3, that is, the portion of the recording paper 3 hanging down from the paper roll 2 in the roll paper drive spindle 12. The slack chamber 27 is between the roll paper drive spindle 12 (delivery mechanism 13) and the conveyance roller 22 (conveyance mechanism 21) on the paper conveyance path 16. In this example, the printer 1 conveys the recording paper 3 while holding the recording paper 3 slack inside the slack chamber 27. Therefore, the paper conveyance path 16, after extending down and back from the paper roll 2 and through the slack chamber 27, travels up and curves to the front, and then continues along the lower paper guide 18 and platen 17 to the front.

Vertically below the roll paper compartment 11 in the case 5 is disposed a detection mechanism 30 configured to detect the slack portion 3*a* of the recording paper 3 in the slack chamber 27. The detection mechanism 30 includes a first detector 31, a second detector 32 vertically below the first detector 31, and a third detector 33 vertically between the first detector 31 and second detector 32.

The first detector 31 has a first emitter 31*a* that emits a first detection beam L1, and a first photodetector 31*b* able to detect the first detection beam L1 that past through the slack chamber 27.

The second detector 32 has a second emitter 32*a* that emits a second detection beam L2, and a second photodetector 32*b* able to detect the second detection beam L2 that past through the slack chamber 27. The second emitter 32*a* is vertically below the first emitter 31*a*, and the second photodetector 32*b* is vertically below the first photodetector 31*b*.

The third detector 33 has a third emitter 33*a* that emits a third detection beam L3, and a third photodetector 33*b* able to detect the third detection beam L3 that past through the slack chamber 27. The third emitter 33*a* is vertically between the first emitter 31*a* and second emitter 32*a*, and the third photodetector 33*b* is vertically between the first photodetector 31*b* and second photodetector 32*b*.

The first emitter 31*a*, third emitter 33*a* and second emitter 32*a* are LEDs, and the first detection beam L1, third detection beam L3 and second detection beam L2 are diffuse light.

The detection mechanism 30 causes the first emitter 31*a*, third emitter 33*a*, and second emitter 32*a* to emit sequentially, one at a time, at a previously set interval. This set interval is, in this example, 0.1 s. If the light detected by the first photodetector 31*b*, third photodetector 33*b*, and second photodetector 32*b* exceeds a set threshold, that photodetector is determined to have detected light, and a signal is output from that photodetector (detector).

The first emitter 31*a* and first photodetector 31*b* of the first detector 31 are positioned so that the virtual path through which the first detection beam L1 emitted from the first emitter 31*a* reaches the first photodetector 31*b*, that is, a straight line between the first emitter 31*a* and first photodetector 31*b*, passes through a point separated from the axis of rotation L0 of the roll paper drive spindle 12 by more than the radius of the largest paper roll 2 that may be loaded in the roll paper drive spindle 12.

In this example, the emitters 31*a*, 32*a*, 33*a* are evenly spaced vertically. The photodetectors 31*b*, 32*b*, 33*b* are also evenly spaced vertically. The spacing between the emitters 31*a*, 32*a*, 33*a*, and the spacing between the photodetectors 31*b*, 32*b*, 33*b*, is the same. The emitters 31*a*, 32*a*, 33*a* and photodetectors 31*b*, 32*b*, 33*b* are also disposed so that the optical axes of the detection beams L1, L2, L3 are parallel, and when the printer 1 is placed on a level surface, the optical axes of the detection beams L1, L2, L3 are also level. Note that spacing between the emitters 31*a*, 32*a*, 33*a*, and the spacing between the photodetectors 31*b*, 32*b*, 33*b*, does not need to be the same, and the optical axes of the detection beams L1, L2, L3 do not need to be parallel. When the printer 1 is placed on a level surface, the optical axes of the detection beams L1, L2, L3 may also be at an angle to level.

Control System

Figure 2:
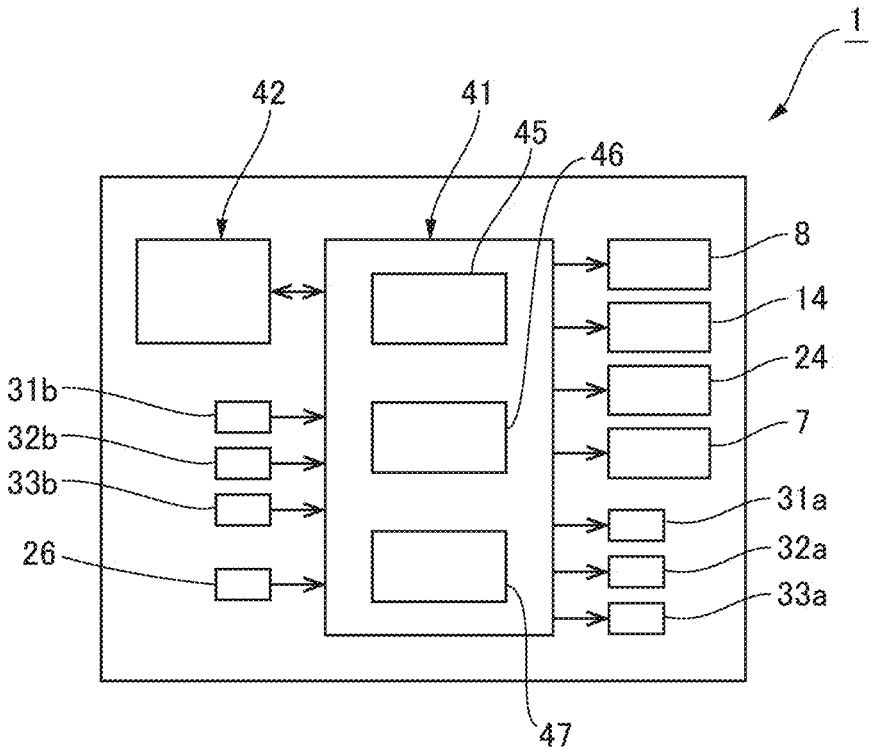
FIG. 2 is a block diagram of the control system of the printer in FIG. 1.
Figure 3:
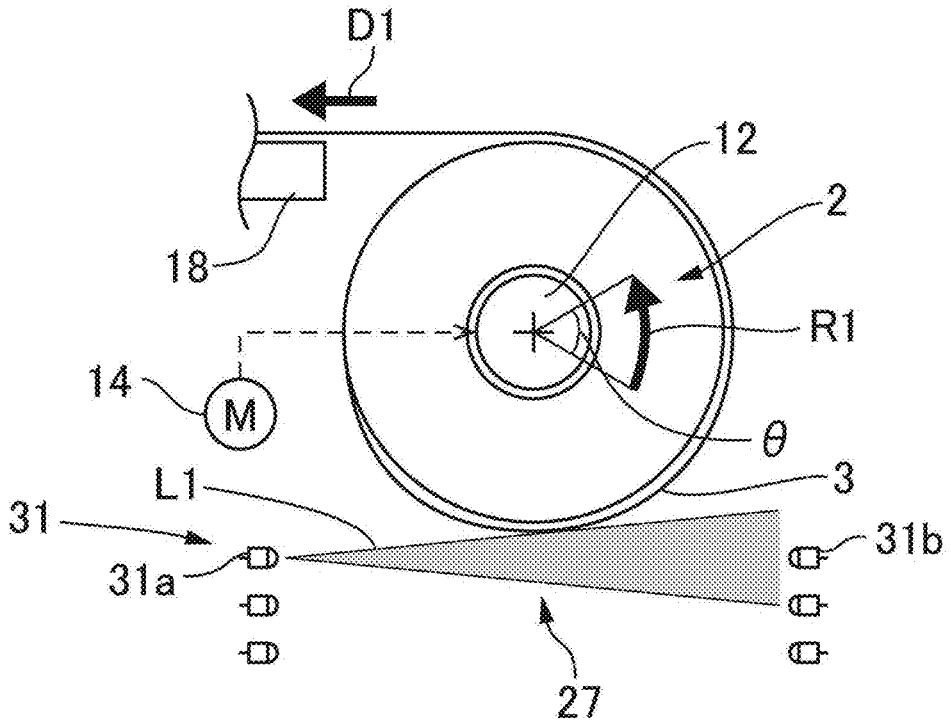
FIG. 3 describes the delivery mechanism drive control operation of the print controller.
Figure 4:
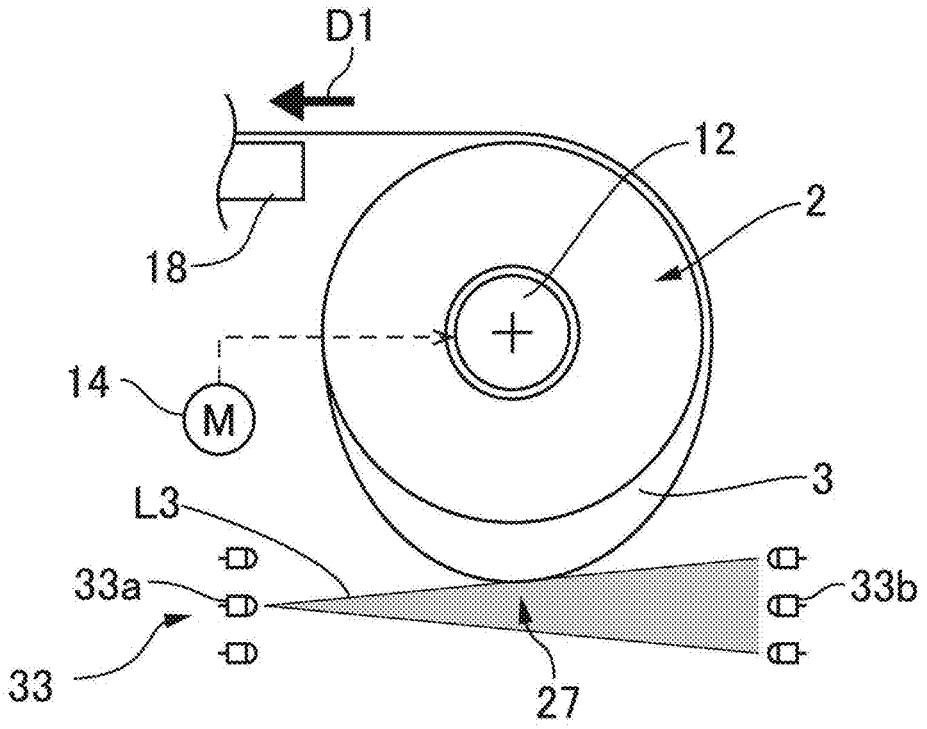
FIG. 4 describes the delivery mechanism drive control operation of the print controller.
Figure 5:
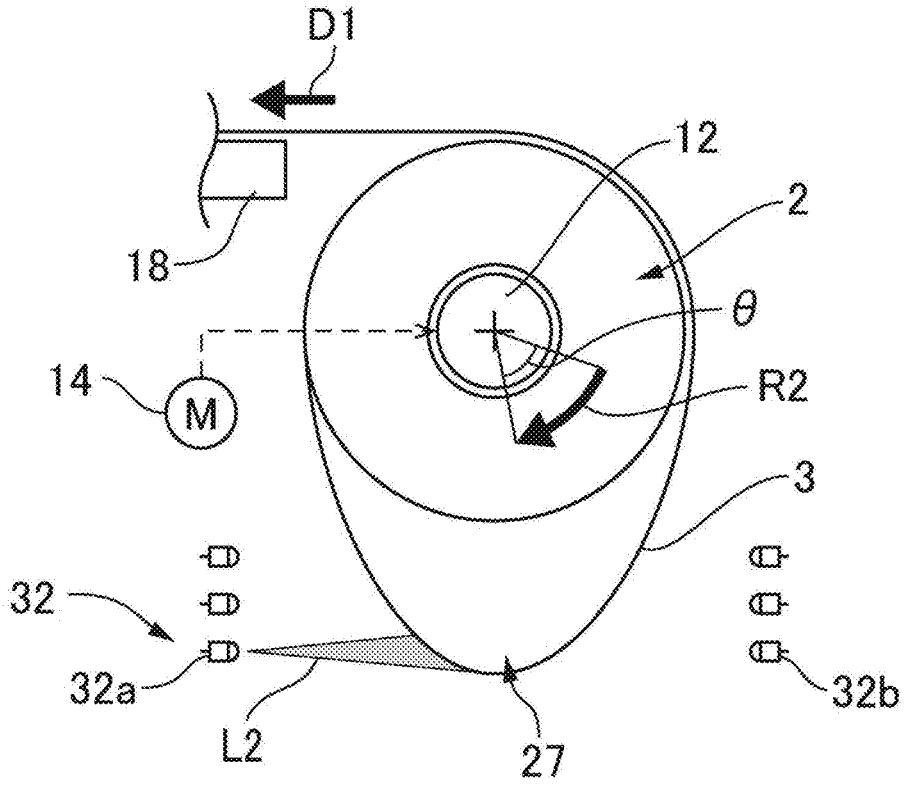
FIG. 5 describes the delivery mechanism drive control operation of the print controller.
Figure 6:
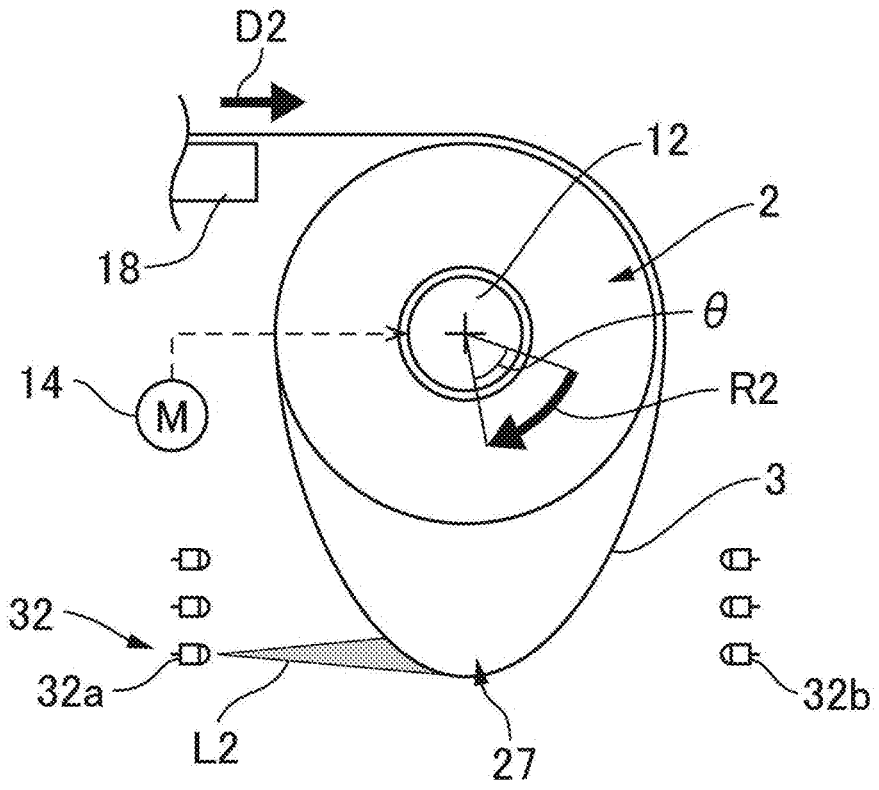
FIG. 6 describes the delivery mechanism drive control operation of the indexing controller.
Figure 7:
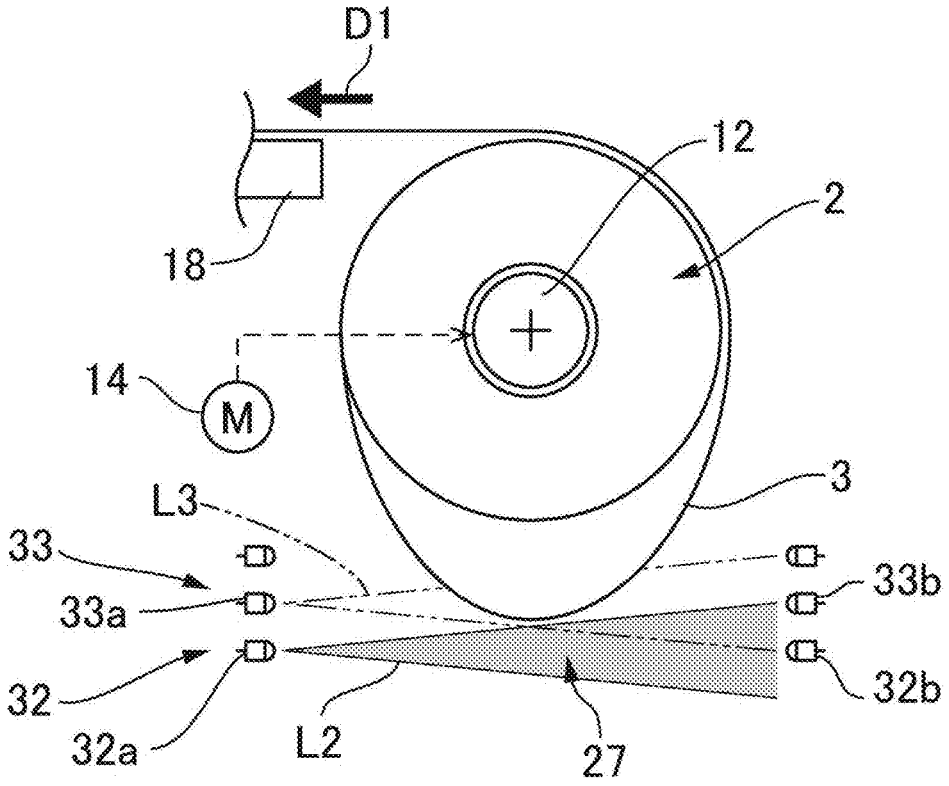
FIG. 7 describes the delivery mechanism drive control operation of the print controller.

FIG. 2 is a block diagram of the control system of the printer 1. FIG. 3 to FIG. 5 describe the operation whereby the print controller 46 controls driving the delivery mechanism 13. FIG. 6 and FIG. 7 describe the operation whereby the indexing controller 47 controls driving the delivery mechanism 13.

The printer 1 has a controller 41 including a CPU and memory. A communicator 42 for communicating with external devices is connected to the controller 41. To the input side of the controller 41 are connected a nip sensor 26, and the photodetectors 31*b*, 32*b*, 33*b* of the detection mechanism 30. To the output side of the controller 41 are connected an automatic cutter 7, printhead 8, spindle drive motor 14, conveyance motor 24, and the emitters 31*a*, 32*a*, 33*a* of the detection mechanism 30. The controller 41 includes a detection mechanism controller 45, print controller 46, and indexing controller 47.

The detection mechanism controller 45 controls driving the first emitter 31*a*, third emitter 33*a*, and second emitter 32*a*. More specifically, the detection mechanism controller 45, at a previously set interval, sequentially causes the first emitter 31*a*, third emitter 33*a* and second emitter 32*a* to emit one at a time. In this example, the detection mechanism controller 45, when the printer 1 power turns on, starts the emitting operation causing the first emitter 31*a*, third emitter 33*a* and second emitter 32*a* to emit sequentially one at a time.

When print data is supplied from an external device, the print controller 46 drives the conveyance motor 24 (conveyance mechanism 21) forward, and conveys the recording paper 3 from the conveyance roller 22 in a first direction D1 toward the printing position A. The print controller 46 also drives the printhead 8 to print on the recording paper 3 passing the printing position A in the first direction D1. While conveying the recording paper 3, the print controller 46, based on output from the first photodetector 31*b* when the first emitter 31*a* emits, output from the third photodetector 33*b* when the third emitter 33*a* emits, and output from the second photodetector 32*b* when the second emitter 32*a* emits, drives the spindle drive motor 14 (delivery mechanism 13) to deliver recording paper 3 from the paper roll 2, and return (rewind) recording paper 3 to the paper roll 2 side. If a cut command is included in the print data, the print controller 46 drives the conveyance motor 24 forward after printing the print data is completed, and conveys the recording paper 3 to the cutting position B. The print controller 46 then drives the automatic cutter 7 to cut the recording paper 3 at the cutting position B.

As shown in FIG. 3, if the first photodetector 31*b* detects the first detection beam L1 while the conveyance motor 24 is being driven (conveyance mechanism 21 is being driven) and the recording paper 3 is being conveyed in the first direction D1, the print controller 46 drives the spindle drive motor 14 forward to turn the roll paper drive spindle 12 in the first direction of rotation R1 and deliver recording paper 3 from the paper roll 2. In other words, if the recording paper 3 is being conveyed in the first direction D1, and a signal indicating that the first detection beam L1 was detected when the first emitter 31*a* emitted is input from the first photodetector 31*b*, the roll paper drive spindle 12 turns and recording paper 3 is delivered from the paper roll 2.

As shown in FIG. 4, if the first photodetector 31*b* does not detect the first detection beam L1, but third photodetector 33*b* detects the third detection beam L3 and second photodetector 32*b* detects the second detection beam L2, while the conveyance motor 24 is being driven and recording paper 3 is conveyed in the first direction D1, the print controller 46 does not drive the spindle drive motor 14 and keeps the spindle drive motor 14 stopped. In other words, the roll paper drive spindle 12 remains stationary (not turning) if when the recording paper 3 is being conveyed in the first direction D1, a signal indicating the detection beam is detected is not output from the first photodetector 31*b* when the first emitter 31*a* emitted, but a signal indicating the detection beam was detected is input to the controller 41 from the third photodetector 33*b* while the third emitter 33*a* emits, and a signal indicating the detection beam was detected is input from the second photodetector 32*b* while the second emitter 32*a* emits.

As shown in FIG. 5, if the second photodetector 32*b* does not detect the second detection beam L2 while the recording paper 3 is conveyed in the first direction D1 by the conveyance motor 24 driving forward, the print controller 46 drives the spindle drive motor 14 to turn the roll paper drive spindle 12 in the second direction of rotation R2, which is the opposite of the first direction of rotation R1, and return (rewind) the recording paper 3 to the paper roll 2 side. In other words, if while the recording paper 3 is being conveyed and the second emitter 32*a* is emitting, a signal indicating that the detection beam was detected is not input from the second photodetector 32*b* to the controller 41, the roll paper drive spindle 12 turns and the recording paper 3 is rewound in the opposite direction as the delivery direction. Note that when the roll paper drive spindle 12 turns in the second direction of rotation R2, the spindle drive motor 14 is driven in the opposite direction as when the roll paper drive spindle 12 turns in the first direction of rotation R1.

When driving the spindle drive motor 14, the print controller 46 drives the spindle drive motor 14 for only a previously defined set time. As a result, the roll paper drive spindle 12 turns only a predetermined set angle of rotation •. In this example, the set time the print controller 46 drives the spindle drive motor 14 forward, and the set time the print controller 46 drives the spindle drive motor 14 in reverse, are the same.

When print data is supplied, the indexing controller 47 also performs an indexing operation to index the recording paper 3 from the cutting position B to the printing position A. In the indexing operation, the indexing controller 47 conveys the recording paper 3 from the cutting position B only a previously set first set conveyance distance in the second direction D2, which is the reverse of the first direction D1, and then conveys the recording paper 3 only a previously set second set conveyance distance, which is shorter than the first set conveyance distance, in the first direction D1. This positions the target start-printing position on the recording paper 3 to the printing position A.

More specifically, in the indexing operation, the indexing controller 47 drives the conveyance motor 24 and conveys the recording paper 3 in the second direction D2. The indexing controller 47 drives the spindle drive motor 14 (delivery mechanism 13), and reverses the recording paper 3, based on the output from the first photodetector 31*b* when the first emitter 31*a* emits, the output from the third photodetector 33*b* when the third emitter 33*a* emits, and the output from the second photodetector 32*b* when the second emitter 32*a* emits while the recording paper 3 is conveyed in the second direction D2. After the recording paper 3 is conveyed only the first set conveyance distance in the second direction D2, the indexing controller 47 drives the conveyance motor 24 and conveys the recording paper 3 in the first direction D1.

For example, as shown in FIG. 6, if the second photodetector 32*b* does not detect the second detection beam L2 (if a signal, indicating that the second detection beam L2 was detected when the second emitter 32*a* emitted, is not input from the second photodetector 32*b* to the controller 41) while the recording paper 3 is conveyed in the second direction D2 (while conveyance mechanism 21 is driven), the indexing controller 47 drives the spindle drive motor 14 to return (rewind) the recording paper 3 to the paper roll 2 side. After conveying the recording paper 3 in the second direction D2 ends, as shown in FIG. 7, if the third photodetector 33*b* does not detect the third detection beam L3, but the second photodetector 32*b* detects the second detection beam L2 (a signal from the second photodetector 32*b* indicating that the second detection beam L2 was detected is input to the controller 41), the indexing controller 47 drives the conveyance motor 24 in the forward direction and conveys the recording paper 3 in the first direction D1.

If the first photodetector 31*b* detected the first detection beam L1 while the recording paper 3 is conveyed in the first direction D1, the indexing controller 47, as shown in FIG. 3, drives the spindle drive motor 14 to turn the roll paper drive spindle 12 in the first direction of rotation R1 to deliver recording paper 3 from the paper roll 2. If while the recording paper 3 is conveyed in the first direction D1, the first photodetector 31*b* does not detect the first detection beam L1, the third photodetector 33*b* detects the third detection beam L3, and the second photodetector 32*b* detects the second detection beam L2, as shown in FIG. 4, the indexing controller 47 does not drive the spindle drive motor 14, which remains stopped. In other words, the indexing controller 47, when conveying the recording paper 3 in the first direction D1, controls driving the delivery mechanism 13 in the same way as the print controller 46.

Indexing Operation

Figure 8:
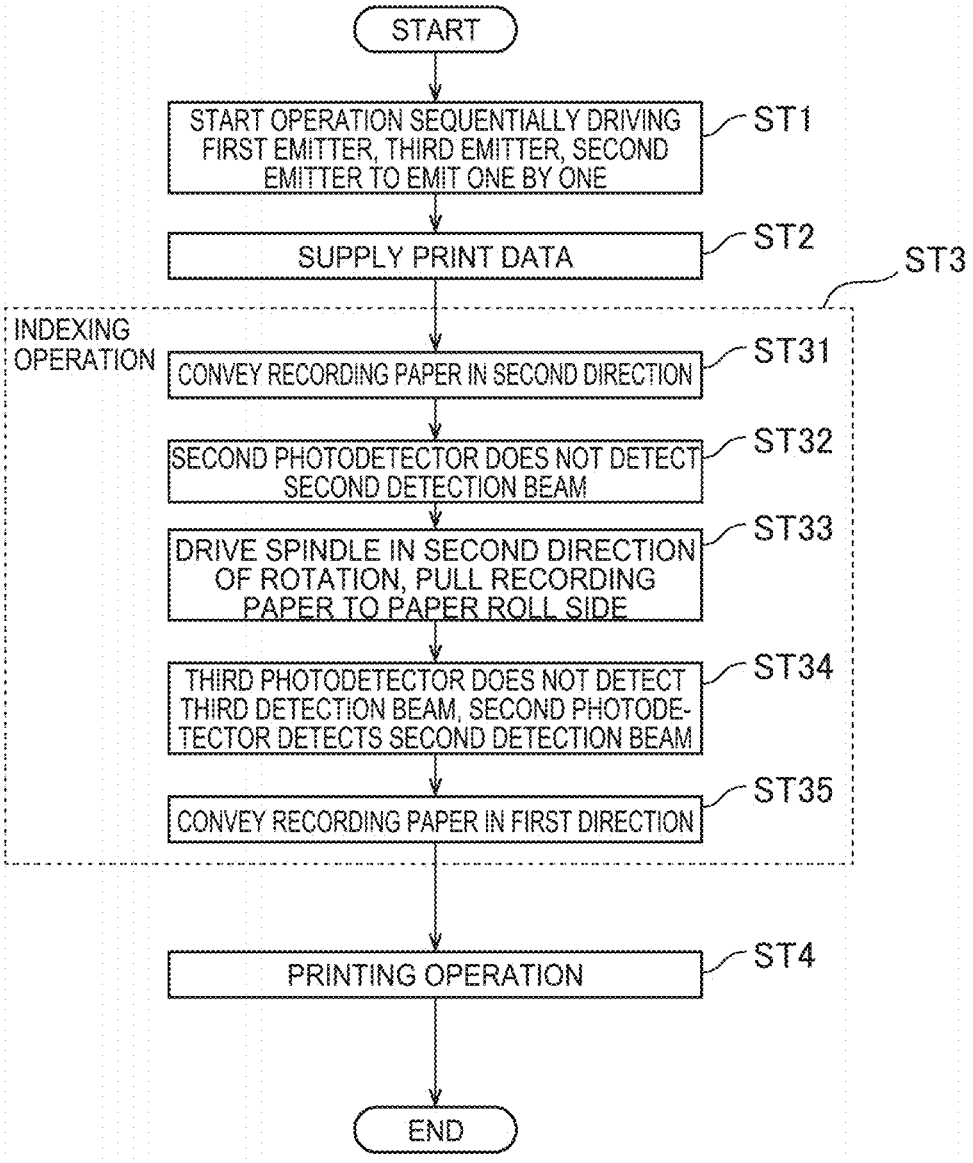
FIG. 8 is a flow chart of the indexing operation.

FIG. 8 is a flow chart of the indexing operation. When the operation shown in the flow chart starts, the printer 1 has finished one print job, and the printed portion of the recording paper 3 was cut by the automatic cutter 7. The recording paper 3 is therefore at the cutting position B. The printer 1 has also started the emitting operation causing the first emitter 31*a*, third emitter 33*a* and second emitter 32*a* to emit sequentially one at a time at the set interval (step ST1).

When print data is supplied from an external device (step ST2), the printer 1 executes the indexing operation (step ST3). As described below, in the indexing operation, the printer 1 conveys the recording paper 3 only a first set conveyance distance in the second direction D2, and then conveys the recording paper 3 only the • second set conveyance distance in the first direction D1.

In the indexing operation, the printer 1 first drives the conveyance motor 24 and conveys the recording paper 3 in the second direction D2 (step ST31). As a result, if the slack portion 3*a* of the recording paper 3 in the slack chamber 27 increases (if the amount of slack in the recording paper 3 increases), the second photodetector 32*b* of the detection mechanism 30 no longer detects the second detection beam L2 (step ST32).

If the second photodetector 32*b* stops detecting the second detection beam L2, the printer 1 drives the spindle drive motor 14 to turn the roll paper drive spindle 12 in the second direction of rotation R2 and return the recording paper 3 to the paper roll 2 side (step ST33). As a result, the printer 1 goes to a mode in which the third photodetector 33*b* does not detect the third detection beam L3 when the third emitter 33*a* emits the third detection beam L3, and the second photodetector 32*b* detects the second detection beam L2 emitted from the second emitter 32*a* when a set time has past after the third emitter 33*a* detected the second detection beam L2 (step ST34).

In step ST34, when the third photodetector 33*b* does not detect the third detection beam L3, and the second photodetector 32*b* detects the second detection beam L2, the printer 1 drives the conveyance motor 24 in the forward direction and conveys the media only the second set conveyance distance in the first direction D1. As a result, the operation indexing the recording paper 3 ends (step ST35).

In the indexing operation in step ST3, the amount of slack in the recording paper 3 inside the slack chamber 27 increases when the recording paper 3 is conveyed in the second direction D2 in step ST31. The second photodetector 32*b* not detecting the second detection beam L2 in step ST32 means the first detection beam L1, third detection beam L3, and second detection beam L2 are blocked by the slack portion 3*a* of the recording paper 3 hanging in the slack chamber 27, and there is excess slack in the recording paper 3 (see FIG. 6). The printer 1, therefore, in step ST33, pulls the recording paper 3 back to the paper roll 2 side, and reduces the amount of slack in the recording paper 3 in the slack chamber 27. As a result, excess slack in the recording paper 3 interfering with the case 5 or other components and obstructing normal conveyance of the recording paper 3 can be prevented.

In step ST35 conveying the recording paper 3 in the first direction D1 after being conveyed in the second direction D2, the slack portion 3*a* of the recording paper 3 in the slack chamber 27 is pulled to the conveyance mechanism 21 side when conveyance in the first direction D1 starts, and the amount of slack in the recording paper 3 decreases. An appropriate amount of slack can therefore be formed in the recording paper 3 hanging in the slack chamber 27 when conveyance in the first direction D1 starts after the recording paper 3 is conveyed in the second direction D2 by, in step ST34 before conveying the recording paper 3 in the first direction D1, the slack is adjusted so that the third detection beam L3 is not detected by the third photodetector 33*b*, and the second detection beam L2 is detected by the second photodetector 32*b* (see FIG. 7).

Furthermore, if in step ST34 the third detection beam L3 is not detected by the third photodetector 33*b*, and the second detection beam L2 is detected by the second photodetector 32*b*, the amount the roll paper drive spindle 12 is driven in the second direction of rotation R2 can be suppressed compared with the third detection beam L3 being detected by the third photodetector 33*b* in step ST34.

Printing Operation

Figure 9:
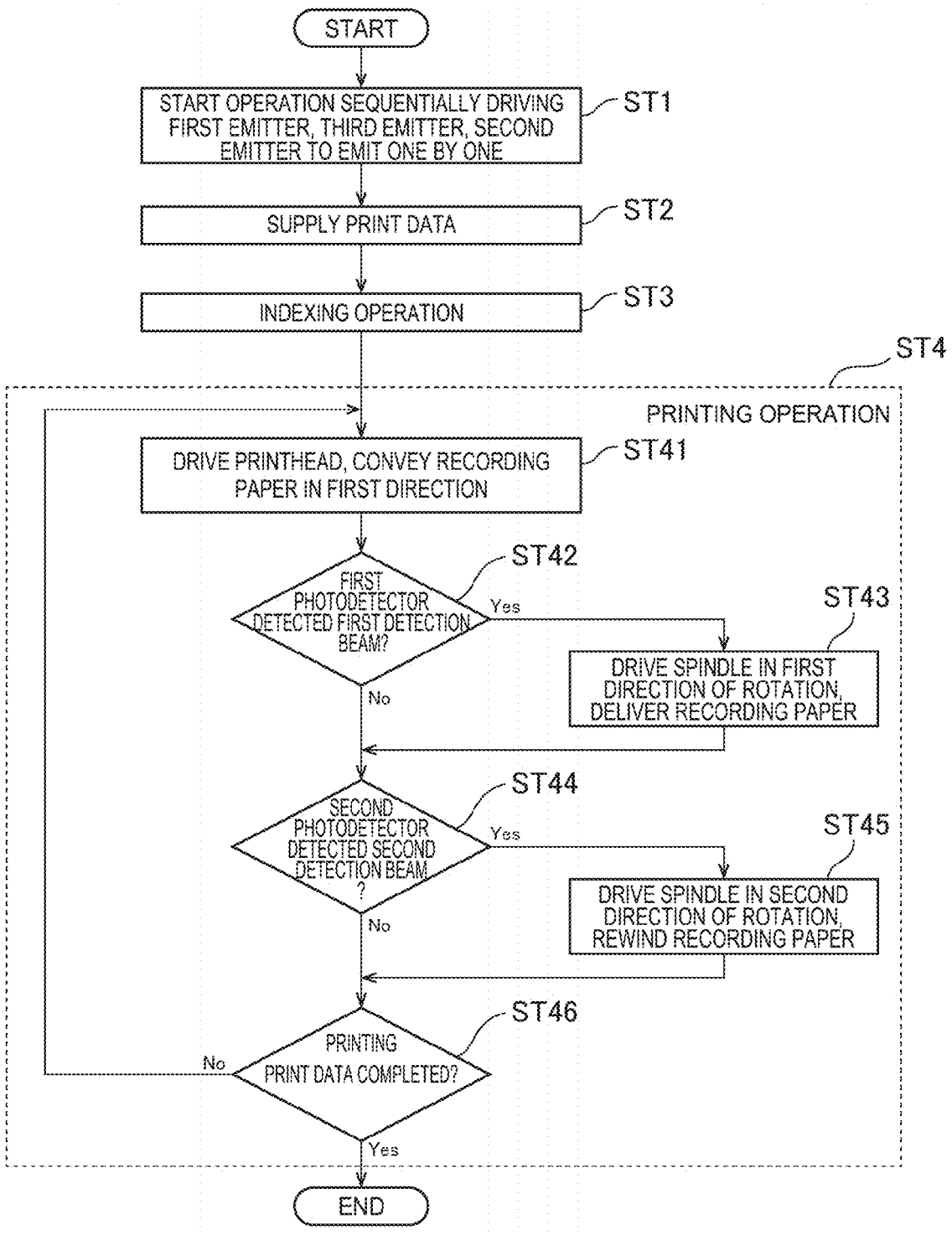
FIG. 9 is a flow chart of the printing operation.

When the indexing operation ends, the printer 1 starts the printing operation (step ST4). FIG. 9 is a flow chart of the printing operation. In the printing operation, the printer 1 drives the conveyance motor 24 and conveys the recording paper 3 in the first direction D1. The printer 1 also drives the printhead 8 to print on the recording paper 3 as it passes the printing position A (step ST41). The printer 1 also drives the spindle drive motor 14 based on output from the first photodetector 31*b*, third photodetector 33*b* and second photodetector 32*b* of the detection mechanism 30.

If during the printing operation (during the conveyance operation) the first photodetector 31*b* detects the first detection beam L1 (step ST42: Yes), the • printer 1 drives the spindle drive motor 14, turns the roll paper drive spindle 12 in the first direction of rotation R1, and delivers recording paper 3 (step ST43). More specifically, that the first photodetector 31*b* detects the first detection beam L1 means that, as shown in FIG. 3, the slack portion 3*a* of the recording paper 3 in the slack chamber 27 does not obstruct the first detection beam L1, and slack in the recording paper 3 is not detected by the detection mechanism 30. Therefore, in this case, the spindle drive motor 14 drives in the forward direction, delivers recording paper 3 into the slack chamber 27, and creates slack in the recording paper 3.

If during the printing operation (during the conveyance operation) the first photodetector 31*b* does not detect the first detection beam L1 (step ST42: No), • the third photodetector 33*b* detects the third detection beam L3, and the • second photodetector 32*b* detects the second detection beam L2 (step ST44: No), the printer 1 does not operate the spindle drive motor 14, which remains stopped. If during the emission cycle of the emitters 31*a*, 32*a*, 33*a* the first photodetector does not detect the first detection beam L1, and the second photodetector 32*b* detects the second detection beam L2, as shown in FIG. 4, only the first detection beam L1 is blocked by the slack portion 3*a* of the recording paper 3 in the slack chamber 27. In this case, there is sufficient slack in the recording paper 3 and not too much slack. The printer 1 therefore does not drive the spindle drive motor 14 (delivery mechanism 13), and conveys the recording paper 3 by driving the conveyance motor 24 (conveyance mechanism 21).

If during the printing operation (during the conveyance operation) the second photodetector 32*b* does not detect the second detection beam L2 (step ST44: Yes), the printer 1 drives the spindle drive motor 14, turns the roll paper drive spindle 12 in the second direction of rotation R2, and pulls the recording paper 3 back to the paper roll 2 side (step ST45). In other words, if the first detection beam L1, third detection beam L3, and second detection beam L2 are blocked by the slack portion 3*a* of the recording paper 3 in the slack chamber 27, there may be too much slack in the recording paper 3. Therefore, when the second photodetector 32*b* does not detect the second detection beam L2, the recording paper 3 is pulled back by the roll paper drive spindle 12 by driving the spindle drive motor 14, and slack in the recording paper 3 decreases. As a result, excess slack in the recording paper 3 interfering with the case 5 or other components and obstructing normal conveyance of the recording paper 3 can be prevented.

The printer 1 then repeats steps ST41 to ST45 until printing the print data is completed (step ST46: Yes).

Note that when the spindle drive motor 14 (delivery mechanism 13) is driven in the printer 1, the roll paper drive spindle 12 turns only a set angle of rotation •. As the recording paper 3 is used and the diameter of the paper roll 2 becomes smaller, the amount of recording paper 3 delivered into the slack chamber 27 decreases, compared with when the diameter of the paper roll 2 is large, when the roll paper drive spindle 12 turns only the set angle of rotation •. However, compared with when the diameter of the paper roll 2 is large, when the diameter of the paper roll 2 is small, the distance from the paper roll 2 to the optical axis of the first detection beam L1 increases. Therefore, even if the amount of recording paper 3 delivered from the paper roll 2 when the spindle drive motor 14 is driven decreases, sufficient slack can be maintained in the recording paper 3.

Operating Effect

In this example, the first emitter 31*a*, third emitter 33*a* and second emitter 32*a* emit sequentially one at a time. The detection beam the first photodetector 31*b* detects when the first emitter 31*a* emits is therefore first detection beam L1; the detection beam the third photodetector 33*b* detects when the third emitter 33*a* emits is the third detection beam L3; and the detection beam the second photodetector 32*b* detects when the second emitter 32*a* emits is the second detection beam L2. Slack detection errors therefore do not occur even if, as a result of a narrow gap between the photodetectors photodetector 31*b*, 32*b*, 33*b*, the first photodetector 31*b* is positioned where it can detect the second detection beam L2 from the third emitter 33*a*, the third photodetector 33*b* is positioned where it can detect the first detection beam L1 from the first emitter 31*a* and the second detection beam L2 from the second emitter 32*a*, and the second photodetector 32*b* is located where it can detect the third detection beam L3 from the third emitter 33*a*.

Figure 10:
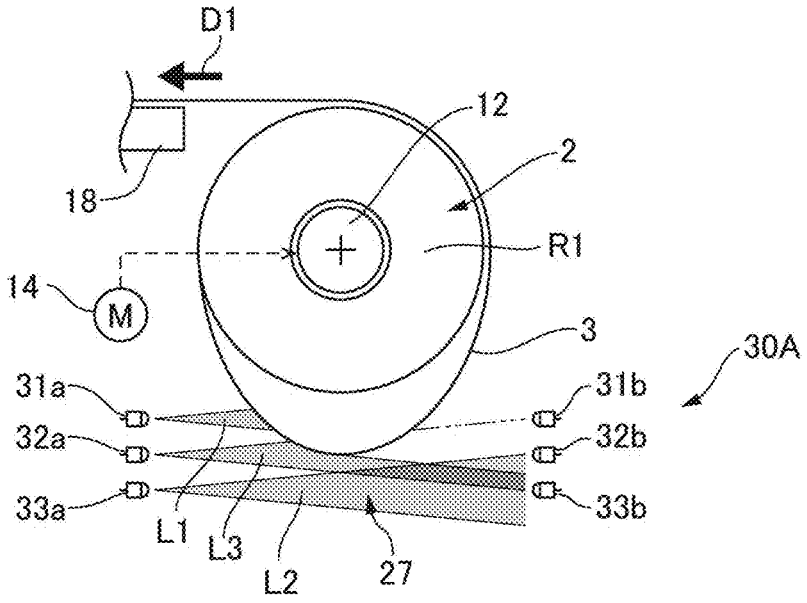
FIG. 10 describes a detection mechanism according to the related art.

FIG. 10 describes a detection errors produced by a detection mechanism according to the related art where plural emitters emit simultaneously.

In the detection mechanism 30A of the related art shown in FIG. 10, emitters 31*a*, 32*a*, 33*a* emit simultaneously. Therefore, when the first photodetector 31*b* is at a position where the third detection beam L3 from the third emitter 33*a* can be detected; the third photodetector 33*b* is located where the first detection beam L1 from the first emitter 31*a*, and the second detection beam L2 from the second emitter 32*a*, can be detected; and the second photodetector 32*b* is located where the third detection beam L3 from the third emitter 33*a* can be detected; it cannot be determined from which emitters 31*a*, 32*a*, 33*a* the detection beams detected by the photodetectors 31*b*, 32*b*, 33*b* were emitted. In the configuration shown in FIG. 10, the third detection beam L3 emitted from the third emitter 33*a* is blocked by the slack portion 3*a* of the recording paper 3 in the slack chamber 27. However, because the third photodetector 33*b* for detecting the third detection beam L3 is disposed to a position where the second detection beam L2 from the second emitter 32*a* can be detected, the third photodetector 33*b* may detect the second detection beam L2. The controller 41 (print controller 46 and indexing controller 47) may therefore mistakenly detect detection of the second detection beam L2 by the second photodetector 32*b* as detection of the third detection beam L3.

In this embodiment of the invention, however, because the first emitter 31*a*, third emitter 33*a*, and second emitter 32*a* emit sequentially one by one, the detection beam the first photodetector 31*b* detects when the first emitter 31*a* emits is the first detection beam L1; the detection beam the third photodetector 33*b* detects when the third emitter 33*a* emits is the third detection beam L3; and the detection beam the second photodetector 32*b* detects when the second emitter 32*a* emits is the second detection beam L2. The first photodetector 31*b* mistakenly detecting the second detection beam L2 as the first detection beam L1 can therefore be prevented. The third photodetector 33*b* mistakenly detecting the first detection beam L1 or detecting the second detection beam L2 as detecting the third detection beam L3 can also be prevented. The second photodetector 32*b* mistakenly detecting the third detection beam L3 as the second detection beam L2 can also be prevented. As a result, because the amount of slack in the recording paper 3 can be accurately detected, the recording paper 3 can be reliably be conveyed with slack. Excessive tension working on the recording paper 3 when the recording paper 3 is conveyed can therefore be prevented, and the recording paper 3 can be conveyed precisely past the printing position A. Print quality can therefore be maintained.

Detection errors can therefore be prevented in this embodiment even if the first photodetector 31*b* can detect the third detection beam L3 from the third emitter 33*a*; the third photodetector 33*b* can detect the first detection beam L1 from the first emitter 31*a* and the second detection beam L2 from the second emitter 32*a*; and the second photodetector 32*b* can detect the third detection beam L3 from the third emitter 33*a*. There is, therefore, no need to precisely adjust the photodetectors 31*b*, 32*b*, 33*b* to detect only the optical axis of the detection beam L1, L2, L3 emitted by the corresponding emitter 31*a*, 32*a*, 33*a*. Printer 1 assembly is therefore simple.

Variations

If, when the conveyance motor 24 is driven and the recording paper 3 is conveyed in the first direction D1, the first photodetector 31*b* does not detect the first detection beam L1, the • third photodetector 33*b* does not detect the third detection beam L3, and the • second photodetector 32*b* detects the second detection beam L2, the print controller 46 may drive the spindle drive motor 14 in the reverse direction to pull the recording paper 3 back to the paper roll 2 side. This can reliably prevent the recording paper 3 drooping more than necessary in the slack chamber 27.

Embodiment 2

General Configuration

Figure 11:
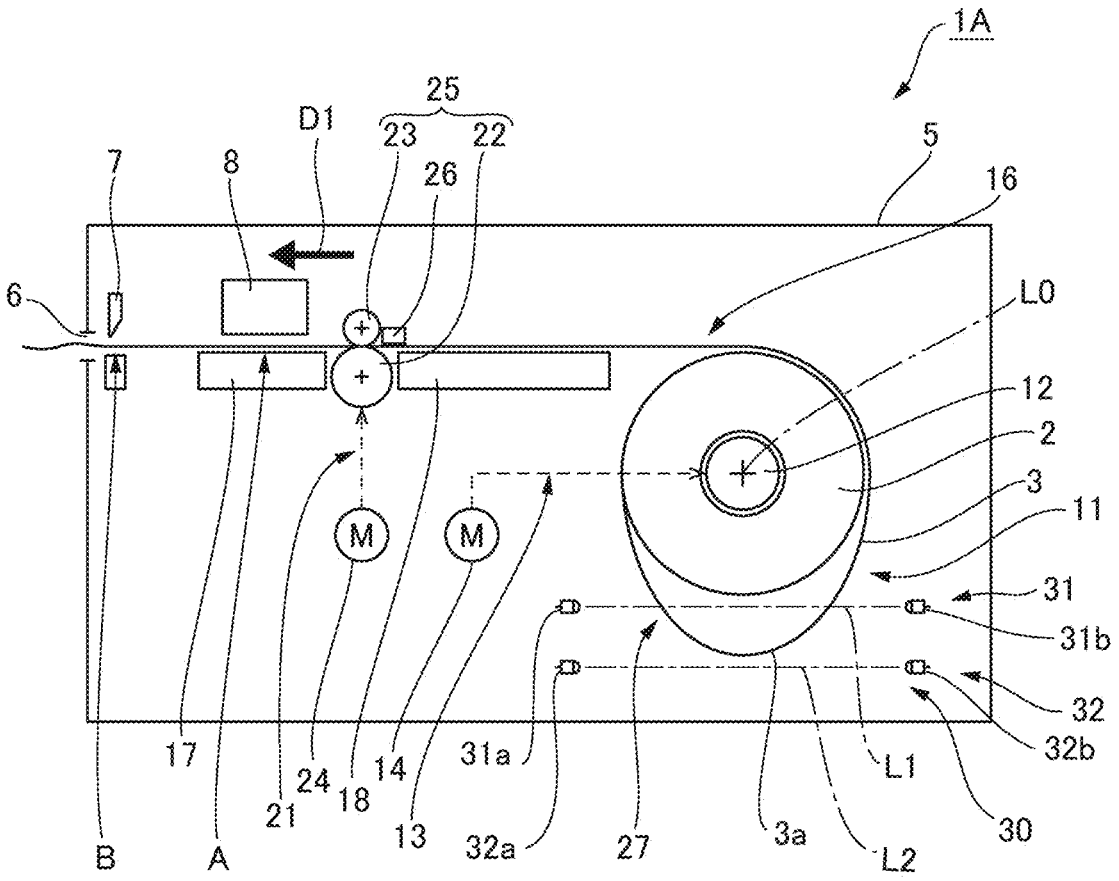
FIG. 11 illustrates a printer according to a second embodiment of the invention.

FIG. 11 illustrates the configuration of printer according to a second embodiment of the invention. The printer 1A in this example differs from the printer 1 in the configuration of the detection mechanism 30. Other aspects of the configuration are the same as in the printer according to the first embodiment above, like parts are therefore referenced by the same reference numerals, and further description thereof is omitted.

The detection mechanism 30 that detects the slack portion 3*a* of the recording paper 3 in the slack chamber 27 in this printer 1A has a first detector 31 and a second detector 32. The first detector 31 has a first emitter 31*a* that emits a first detection beam L1, and a first photodetector 31*b* able to detect the first detection beam L1 that past through the slack chamber 27.

The second detector 32 has a second emitter 32*a* that emits a second detection beam L2, and a second photodetector 32*b* able to detect the second detection beam L2 that past through the slack chamber 27. The second emitter 32*a* is vertically below the first emitter 31*a*, and the second photodetector 32*b* is vertically below the first photodetector 31*b*.

The first emitter 31*a* and second emitter 32*a* are LEDs, and the first detection beam L1 and second detection beam L2 are diffuse light. The detection mechanism 30 causes the first emitter 31*a* and second emitter 32*a* to emit alternately one at a time at a previously set interval. This set interval is, in this example, 0.1 s. If the light detected by the first photodetector 31*b* and second photodetector 32*b* exceeds a set threshold, that photodetector is determined to have detected light, and a signal is output from that photodetector (detector).

The first emitter 31*a* and first photodetector 31*b* of the first detector 31 are positioned so that the virtual path through which the first detection beam L1 emitted from the first emitter 31*a* reaches the first photodetector 31*b*, that is, a straight line between the first emitter 31*a* and first photodetector 31*b*, passes through a point separated from the axis of rotation L0 of the roll paper drive spindle 12 by more than the radius of the largest paper roll 2 that may be loaded in the roll paper drive spindle 12. The emitters 31*a*, 32*a* and photodetectors 31*b*, 32*b* are also disposed so that the optical axes of the detection beams L1, L2 are parallel.

Control System

Figure 12:
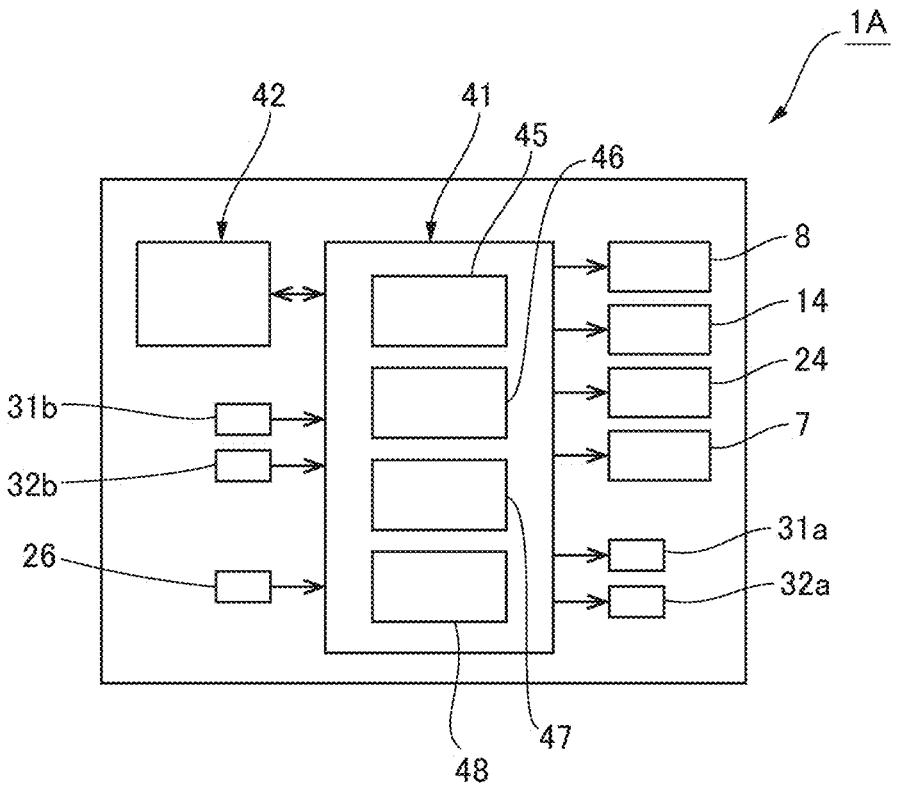
FIG. 12 is a block diagram of the control system of the printer in FIG. 11.
Figure 13:
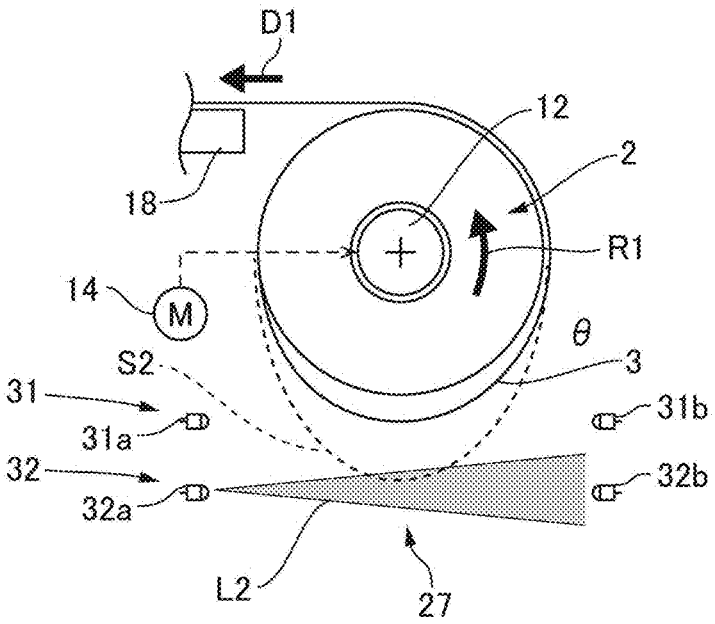
FIG. 13 describes the delivery mechanism drive control operation of the print controller.
Figure 14:
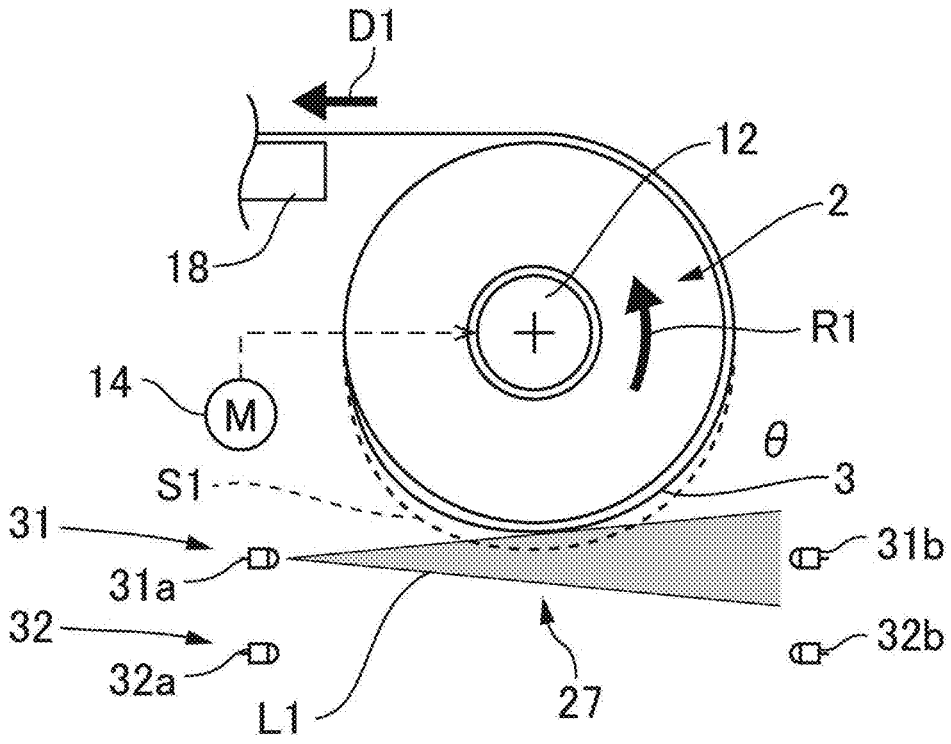
FIG. 14 describes the delivery mechanism drive control operation of the print controller.
Figure 15:
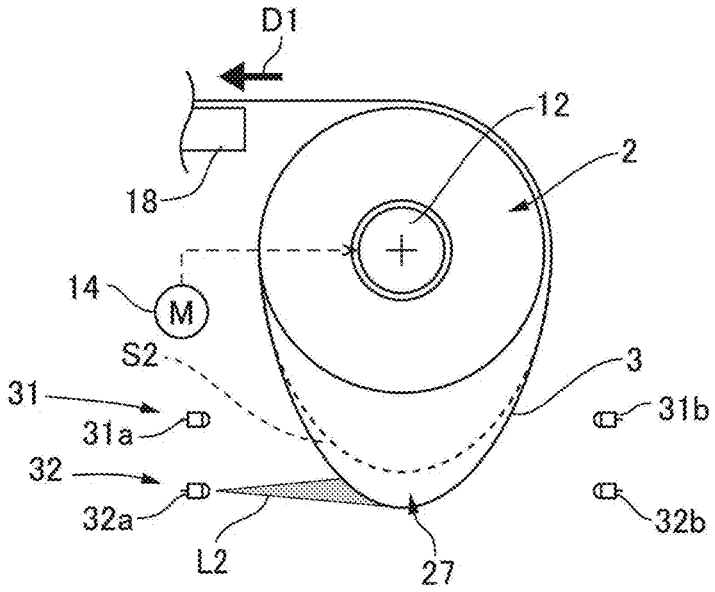
FIG. 15 describes the delivery mechanism drive control operation of the print controller.

FIG. 12 is a block diagram of the control system of the printer 1A. FIG. 13 to FIG. 15 describe the operation whereby the print controller 46 controls driving the delivery mechanism 13 (paper roll rotating mechanism). FIG. 16 to FIG. 19 describe the operation whereby the indexing controller 47 controls driving the delivery mechanism 13. FIG. 20 describes the operation whereby the loading controller 48 controls driving the delivery mechanism 13.

The printer 1A has a controller 41 including a CPU and memory. A communicator 42 for communicating with external devices is connected to the controller 41. To the input side of the controller 41 are connected a nip sensor 26, and the photodetectors 31*b*, 32*b* of the detection mechanism 30. To the output side of the controller 41 are connected an automatic cutter 7, printhead 8, spindle drive motor 14, conveyance motor 24, and the emitters 31*a*, 32*a* of the detection mechanism 30. The controller 41 includes a detection mechanism controller 45, print controller 46, indexing controller 47, and loading controller 48.

In the printer 1 of the first embodiment described above, when the controller 41 drives the spindle drive motor 14, the spindle drive motor 14 is driven for only a previously determined set time. In the printer 1A of this embodiment, however, when the controller 41 drives the spindle drive motor 14, the spindle drive motor 14 operates continuously and continues operating until stopped by the controller 41.

The detection mechanism controller 45 controls driving the first emitter 31*a* and second emitter 32*a*. More specifically, the detection mechanism controller 45, at a previously set interval, sequentially causes the first emitter 31*a* and second emitter 32*a* to emit alternately one at a time. In this example, the detection mechanism controller 45, when the controller 41 drives the conveyance mechanism 21 (conveyance motor 24), executes the emitting operation (detection operation) causing the first emitter 31*a* and second emitter 32*a* to emit alternately one at a time.

When print data is supplied from an external device, the print controller 46 drives the conveyance motor 24 (conveyance mechanism 21) forward, and conveys the recording paper 3 from the conveyance roller 22 in a first direction D1 toward the printing position A. The print controller 46 also drives the printhead 8 to print on the recording paper 3 passing the printing position A in the first direction D1. While conveying the recording paper 3, the print controller 46, based on output from the first photodetector 31*b* when the first emitter 31*a* emits, and output from the second photodetector 32*b* when the second emitter 32*a* emits, controls driving the spindle drive motor 14 (delivery mechanism 13; paper roll rotating mechanism). If a cut command is included in the print data, the print controller 46 drives the conveyance motor 24 forward after printing the print data is completed, and conveys the recording paper 3 to the cutting position B. The print controller 46 then drives the automatic cutter 7 to cut the recording paper 3 at the cutting position B.

The print controller 46, when conveying the recording paper 3 in the first direction D1 by driving the conveyance motor 24 in the forward direction (when driving the conveyance mechanism 21), based on the signals output from the second detector 32, determines whether or not to turn the roll paper drive spindle 12 in the first direction of rotation R1. More specifically, as shown in FIG. 13, if the second photodetector 32*b* detects the second detection beam L2 when the second emitter 32*a* emits the second detection beam L2 (a signal from the second detector 32 is input to the controller 41), the print controller 46 determines it is necessary to drive the roll paper drive spindle 12 in the first direction of rotation R1. More specifically, if the second photodetector 32*b* detects the second detection beam L2 when the second emitter 32*a* emits the second detection beam L2, the amount of slack in the recording paper 3 hanging down from the paper roll 2 is determined to be less than a second threshold S2, and the print controller 46 applies control appropriate to this decision.

When the print controller 46 determines it is necessary to drive the roll paper drive spindle 12 in the first direction of rotation R1, the print controller 46 drives the spindle drive motor 14 in the forward direction and causes the roll paper drive spindle 12 to turn in the first direction of rotation R1. When the roll paper drive spindle 12 turns in the first direction of rotation R1, recording paper 3 is delivered from the paper roll 2. In other words, when the recording paper 3 is being conveyed in the first direction D1, and the second detection beam L2 of the second detector 32, which is the lower detector, is not blocked by the recording paper 3, the print controller 46 determines the slack in the recording paper 3 may be small, and therefore drives the roll paper drive spindle 12 to deliver recording paper 3 from the paper roll 2.

While driving the roll paper drive spindle 12 in the first direction of rotation R1 based on the above decision, the print controller 46, based on signal output from the first detector 31, changes the speed of the roll paper drive spindle 12. In other words, as shown in FIG. 14, if the first photodetector 31*b* detects the first detection beam L1 when the first emitter 31*a* emits the first detection beam L1 (when a signal from the first detector 31 is input to the controller 41), the print controller 46 determines the slack in the recording paper 3 hanging down from the paper roll 2 is less than a first threshold S1. Note that the amount of slack in the recording paper 3 indicated by the first threshold S1 is less than the amount of slack indicated by second threshold S2.

If the slack in the recording paper 3 is less than first threshold S1, the print controller 46 gradually increases the speed of the roll paper drive spindle 12, which is already turning, in the first direction of rotation R1 in steps. As a result, for a specific time, the delivery amount, which is the amount of recording paper 3 delivered from the paper roll 2, increases and the amount of slack increases. However, if the first photodetector 31*b* does not detect the first detection beam L1 when the first emitter 31*a* emits the first detection beam L1, the print controller 46 determines the slack in the recording paper 3 hanging down from the paper roll 2 is greater than or equal to first threshold S1. If the slack in the recording paper 3 is greater than or equal to first threshold S1, the print controller 46 continues driving the roll paper drive spindle 12 in the same way.

While driving the roll paper drive spindle 12 in the first direction of rotation R1 based on the above decision, the print controller 46, based on signal output from the second detector 32, stops driving the roll paper drive spindle 12 in the first direction of rotation R1. More specifically, as shown in FIG. 15, if the second photodetector 32*b* does not detect the second detection beam L2 when the second emitter 32*a* emits the second detection beam L2 (a signal from the second detector 32 is not input to the controller 41), the print controller 46 determines the amount of slack in the recording paper 3 hanging down from the paper roll is greater than or equal to second threshold S2. If the amount of slack in the recording paper 3 is greater than or equal to second threshold S2, the print controller 46 stops the spindle drive motor 14 and stops driving the roll paper drive spindle 12 in the first direction of rotation R1. As a result, the print controller 46 stops delivery of recording paper 3 from the paper roll 2, and suppresses increasing the amount of slack in the recording paper 3. However, if the second photodetector 32*b* detects the second detection beam L2 when the second emitter 32*a* emits the second detection beam L2, the print controller 46 determines the slack in the recording paper 3 is less than second threshold S2, and continues driving the roll paper drive spindle 12.

Note that if the slack in the recording paper 3 hanging down from the paper roll 2 is less than first threshold S1, and the speed of the roll paper drive spindle 12 has already reached the maximum speed (a previously set upper limit), the print controller 46 stops the conveyance mechanism 21 and roll paper drive spindle 12, and reports an error. The delivery amount of paper roll 2 per unit time determined by the speed of the roll paper drive spindle 12 and the diameter of the paper roll 2, and if the above decision is made when the roll paper drive spindle 12 is turning at the maximum speed, the diameter of the paper roll 2 is considered to be less than a specific amount. Therefore, the print controller 46 applies control appropriate to the recording paper 3 running out, or appropriate to some kind of error. The print controller 46 also stops the spindle drive motor 14 if the spindle drive motor 14 is operating when the printing operation ends and the conveyance motor 24 (conveyance mechanism 21) is stopped.

When print data is supplied, the indexing controller 47 also performs an indexing operation to index the recording paper 3 from the cutting position B to the printing position A. In the indexing operation, the indexing controller 47 sequentially executes a positioning operation to set the target start-printing position on the recording paper 3 to the printing position A, and a slack adjustment operation to adjust the slack in the recording paper 3. In the positioning operation, the indexing controller 47 conveys the recording paper 3 from the cutting position B only a previously set conveyance distance in the second direction D2. In the slack adjustment operation, the indexing controller 47 controls driving the roll paper drive spindle 12 based on signal input from the second detector 32 to the controller 41.

Figure 16:
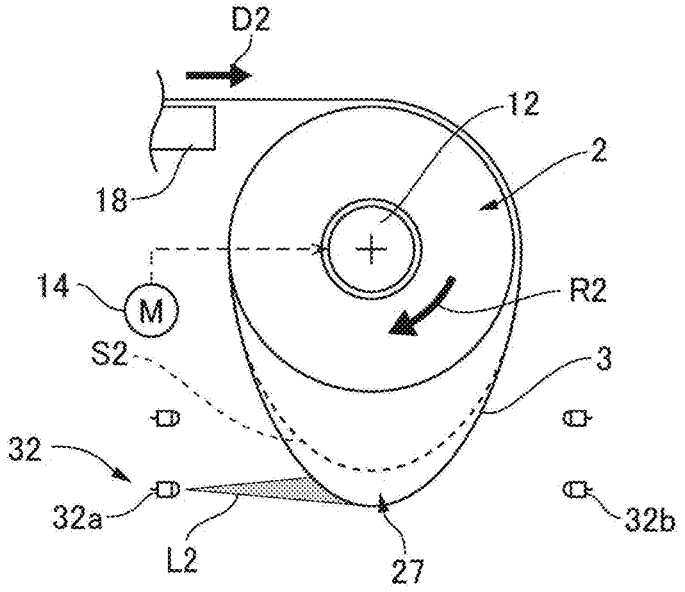
FIG. 16 describes the delivery mechanism drive control operation of the print controller.

In the positioning operation, the indexing controller 47, based on signal output from the second detector 32 while conveying the recording paper 3 in the second direction D2 by driving the conveyance motor 24 in the reverse direction (while driving the conveyance mechanism 21), determines whether or not to drive the roll paper drive spindle 12 in the second direction of rotation R2. More specifically, as shown in FIG. 16, if the second photodetector 32*b* does not detect the second detection beam L2 when the second emitter 32*a* emits the second detection beam L2 (a signal from the second detector 32 is not input to the controller 41), the print controller 46 determines driving the roll paper drive spindle 12 in the second direction of rotation R2 is necessary. More specifically, if second photodetector 32*b* does not detect the second detection beam L2 when the second emitter 32*a* emits the second detection beam L2, the slack in the recording paper 3 hanging down from the paper roll 2 is determined to be greater than or equal to second threshold S2, and the print controller 46 applies control appropriate to this decision.

If driving the roll paper drive spindle 12 in the second direction of rotation R2 is determined necessary, the indexing controller 47 drives the spindle drive motor 14 to turn the roll paper drive spindle 12 in the second direction of rotation R2. When the roll paper drive spindle 12 turns in the second direction of rotation R2, the recording paper 3 is pulled back to the paper roll 2 (rewound). In other words, if while the recording paper 3 is conveyed in the second direction D2, the second detection beam L2 of the lower second detector 32 is blocked by the recording paper 3, the indexing controller 47 determines the slack in the recording paper 3 is great and drives the roll paper drive spindle 12 to rewind the recording paper 3. Note that the direction the spindle drive motor 14 is driven for the roll paper drive spindle 12 to turn in the second direction of rotation R2 is the reverse of the direction the spindle drive motor 14 is driven when the roll paper drive spindle 12 turns in the first direction of rotation R1.

Figure 17:
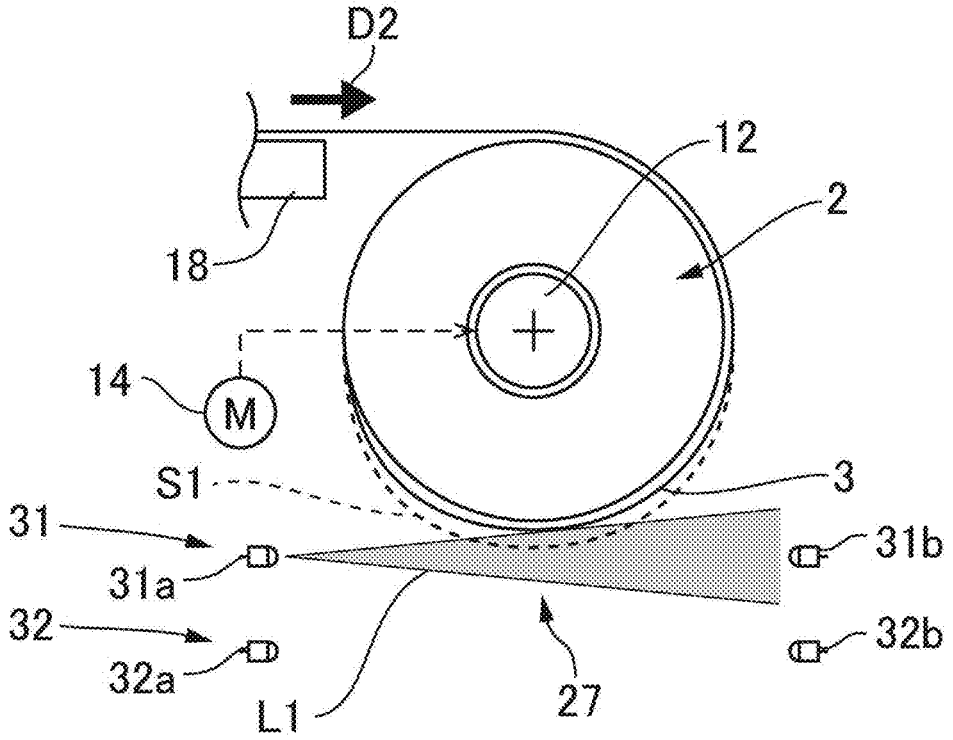
FIG. 17 describes the delivery mechanism drive control operation of the print controller.

When the roll paper drive spindle 12 is driven in the second direction of rotation R2 in the positioning operation based on the above decision, the indexing controller 47, based on signal output from the first detector 31, stops rotation of the roll paper drive spindle 12. In other words, as shown in FIG. 17, if the first photodetector 31*b* detects the first detection beam L1 when the first emitter 31*a* emits the first detection beam L1 (a signal from the first detector 31 is input to the controller 41), the indexing controller 47 determines the slack in the recording paper 3 hanging down from the paper roll is less than first threshold S1. If the slack in the recording paper 3 is less than first threshold S1, the print controller 46 stops driving the spindle drive motor 14 and stops rotation of the roll paper drive spindle 12. As a result, the indexing controller 47 stops rewinding the recording paper 3 and prevents the slack from decreasing excessively.

Figure 18:
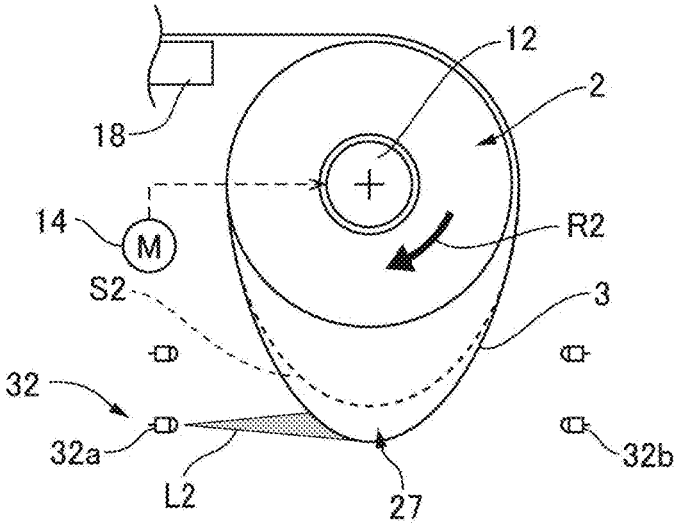
FIG. 18 describes the delivery mechanism drive control operation of the print controller.

After stopping driving the conveyance motor 24 in the positioning operation, the indexing controller 47 executes a slack adjustment operation. In the slack adjustment operation, the indexing controller 47, based on signal output from the second detector 32, determines whether or not to drive the roll paper drive spindle 12 in the second direction of rotation R2. More specifically, as shown in FIG. 18, if the second photodetector 32*b* does not detect the second detection beam L2 when the second emitter 32*a* emits the second detection beam L2 (a signal from the second detector 32 is not input to the controller 41), the indexing controller 47 determines driving the roll paper drive spindle 12 in the second direction of rotation R2 is necessary. If driving the roll paper drive spindle 12 in the second direction of rotation R2 is determined necessary, the indexing controller 47 drives the spindle drive motor 14 to turn the roll paper drive spindle 12 in the second direction of rotation R2. As a result, the recording paper 3 is pulled back to the paper roll 2 (rewound). In other words, after the positioning operation ends, if the second detection beam L2 of the lower second detector 32 is blocked by the recording paper 3, the indexing controller 47 determines there is too much slack in the recording paper 3, and drives the roll paper drive spindle 12 to rewind the recording paper 3. As a result, the indexing controller 47 reduces the amount of slack in the recording paper 3.

Figure 19:
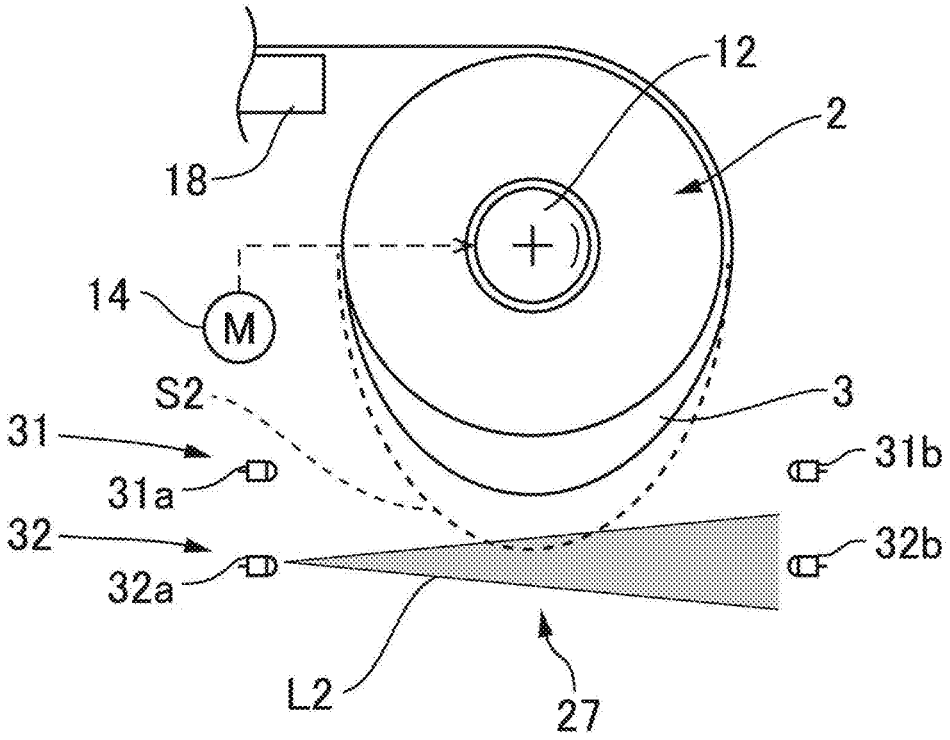
FIG. 19 describes the delivery mechanism drive control operation of the print controller.
Figure 20:
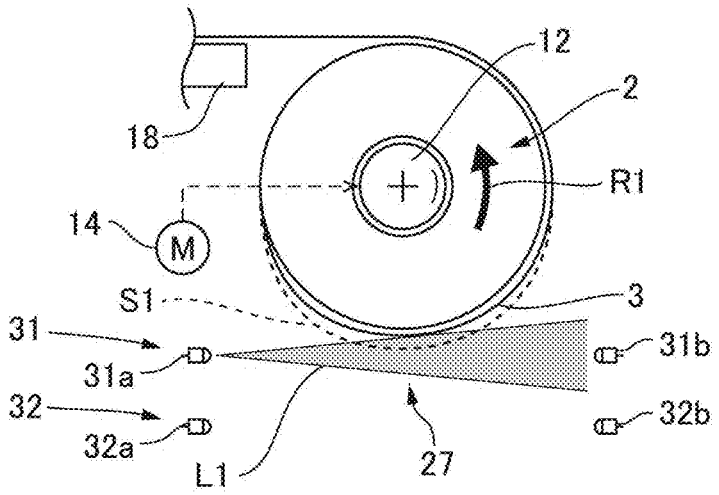
FIG. 20 describes the delivery mechanism drive control operation of the loading controller.

As shown in FIG. 19, if the second photodetector 32*b* detects the second detection beam L2 when the second emitter 32*a* emits the second detection beam L2 (a signal from the second detector 32 is input to the controller 41), the indexing controller 47 determines there is no need to drive the roll paper drive spindle 12 in the second direction of rotation R2. If driving the roll paper drive spindle 12 in the second direction of rotation R2 is determined not necessary, the indexing controller 47 stops the spindle drive motor 14 and stops rotation. If the spindle drive motor 14 is already stopped, it remains stopped.

The loading controller 48 executes a loading operation. The loading operation is executed when a new paper roll 2 is set in the printer 1A. In the loading operation, the conveyance roller pair 25 performs a nipping operation to nip the recording paper 3, and then the slack adjustment operation.

In the nipping operation, the loading controller 48, based on signal input from the nip sensor 26, drives the conveyance motor 24 in the forward direction and conveys the recording paper 3 by the conveyance mechanism 21 only a specific distance in the first direction D1. more specifically when recording paper 3 is set in the paper conveyance path 16, the operator pulls the recording paper 3 from the paper roll 2 through the paper conveyance path 16, and sets the leading end of the recording paper 3 to the nip position N. Based on signal input from the nip sensor 26, the loading controller 48 detects that the recording paper 3 is at the nip position N. After detecting that the recording paper 3 is at the nip position N, the loading controller 48 drives the conveyance motor 24 to convey the recording paper 3 a specific amount, and causes the conveyance roller pair 25 to nip the leading end of the recording paper 3.

After controlling the conveyance mechanism 21 to convey the recording paper 3 only a specific amount in the first direction D1, the loading controller 48 executes the slack adjustment operation. In the slack adjustment operation, the loading controller 48, based on signal input from the first detector 31, determines whether or not to drive the roll paper drive spindle 12 in the first direction of rotation R1. More specifically, as shown in FIG. 20, if the first photodetector 31*b* detects the first detection beam L1 when the first emitter 31*a* emits the first detection beam L1 (a signal from the first detector 31 is input to the controller 41), the loading controller 48 determines driving the roll paper drive spindle 12 in the first direction of rotation R1 is necessary. However, if first photodetector 31*b* does not detect the first detection beam L1 when the first emitter 31*a* emits the first detection beam L1, the loading controller 48 determines driving the roll paper drive spindle 12 in the first direction of rotation R1 is not necessary.

If driving the roll paper drive spindle 12 in the first direction of rotation R1 is determined necessary, the loading controller 48 drives the spindle drive motor 14 to turn the roll paper drive spindle 12 in the first direction of rotation R1. As a result, recording paper 3 is delivered from the paper roll 2. In other words, if, when the recording paper 3 is nipped, the first detection beam L1 of the upper first detector 31 is not blocked by the recording paper 3, the loading controller 48 determines the slack in the recording paper 3 is slight and drives the roll paper drive spindle 12 to deliver recording paper 3.

However, if driving the roll paper drive spindle 12 in the first direction of rotation R1 is determined not necessary, the loading controller 48, based on signal output from the second detector 32, determines whether or not to drive the roll paper drive spindle 12 in the second direction of rotation R2. More specifically, as shown in FIG. 18, if the second photodetector 32*b* does not detect the second detection beam L2 when the second emitter 32*a* emits the second detection beam L2 (a signal from the second detector 32 is not input to the controller 41), the loading controller 48 determines driving the roll paper drive spindle 12 in the second direction of rotation R2 is necessary. However, if second photodetector 32*b* detects the second detection beam L2 when the second emitter 32*a* emits the second detection beam L2, the loading controller 48 determines driving the roll paper drive spindle 12 in the second direction of rotation R2 is not necessary.

If driving the roll paper drive spindle 12 in the second direction of rotation R2 is necessary, the loading controller 48 drives the spindle drive motor 14 to turn the roll paper drive spindle 12 in the second direction of rotation R2. As a result, the recording paper 3 is pulled back to the paper roll 2 (rewound).

More specifically, if the second detection beam L2 of the lower second detector 32 is blocked by the recording paper 3, the loading controller 48 determines there is too much slack in the recording paper 3, and drives the roll paper drive spindle 12 to rewind the recording paper 3. Note that if driving the roll paper drive spindle 12 in the second direction of rotation R2 is not necessary, and the roll paper drive spindle 12 is turning in the second direction of rotation R2, the loading controller 48 stops driving the spindle drive motor 14 and stops the roll paper drive spindle 12 turning.

Indexing Operation

Figure 21:
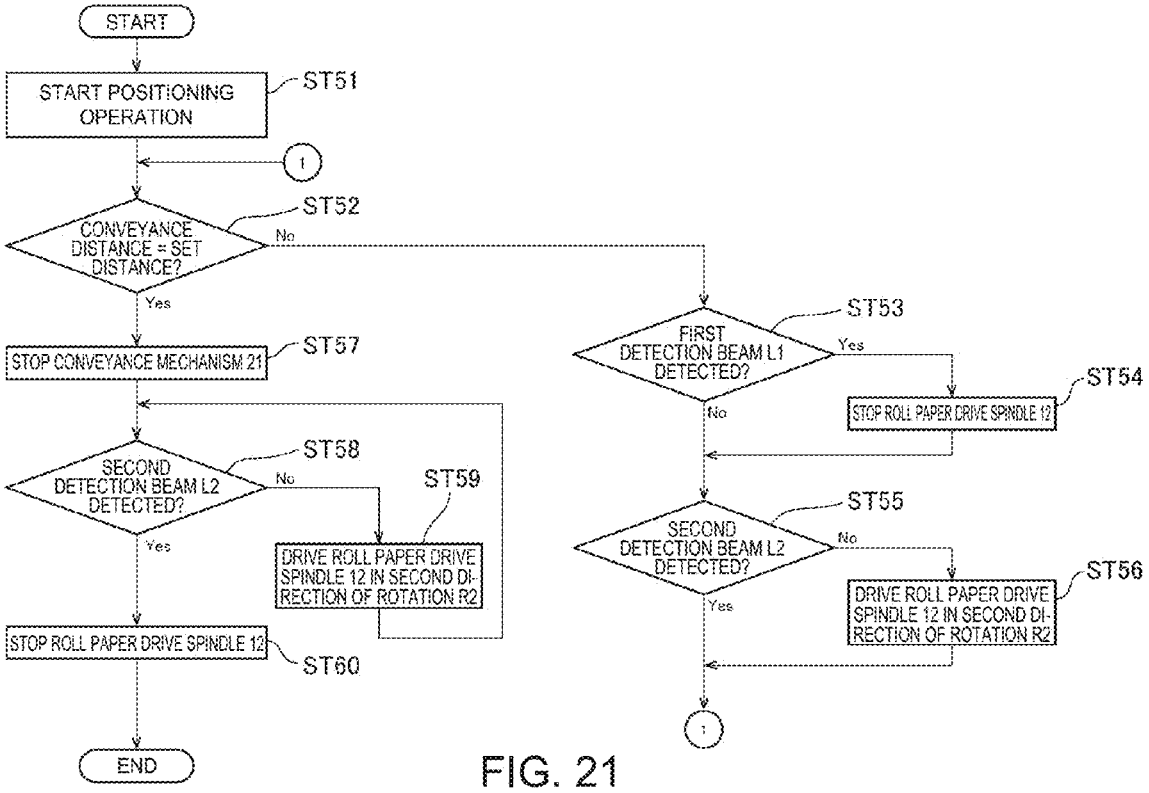
FIG. 21 is a flow chart of the indexing operation.

FIG. 21 is a flow chart of the indexing operation. When the operation shown in the flow chart starts, the printer 1A has finished one print job, and the printed portion of the recording paper 3 was cut by the automatic cutter 7. The recording paper 3 is therefore at the cutting position B.

In the indexing operation the printer 1A executes when print data is supplied from an external device, the printer 1A first starts the positioning operation and conveys the recording paper 3 only a specific distance by the conveyance mechanism 21 in the second direction D2 (step ST51).

After conveyance of the recording paper 3 by the conveyance mechanism 21 in the second direction D2 starts, the indexing controller 47 determines if conveyance distance by the conveyance mechanism 21 has reached a specific conveyance distance (step ST52). If the conveyance distance by the conveyance mechanism 21 has not reached the specific conveyance distance (step ST52: No), that is, while the recording paper 3 is conveyed by the conveyance mechanism 21 only the specific conveyance distance in the second direction D2, the indexing controller 47 determines, based on signal output from the second detector 32, whether or not to drive the roll paper drive spindle 12 in the second direction of rotation R2. When the recording paper 3 is conveyed by the conveyance mechanism 21 in the second direction D2 in the positioning operation, the second detection beam L2 of the second detector 32 is normally blocked by the recording paper 3 as shown in FIG. 16. The second photodetector 32*b* therefore does not detect the second detection beam L2 when the second emitter 32*a* emits the second detection beam L2. As a result, the indexing controller 47 determines driving the roll paper drive spindle 12 in the second direction of rotation R2 is necessary, based on the decision drives the spindle drive motor 14 in the reverse direction, and turns the roll paper drive spindle 12 in the second direction of rotation R2.

If while the indexing controller 47 is driving the conveyance mechanism 21 and conveying the recording paper 3 in the second direction D2, and the roll paper drive spindle 12 is turning in the second direction of rotation R2, the first photodetector 31*b* detects the first detection beam L1 when the first emitter 31*a* emits the first detection beam L1 (step ST53: Yes), as shown in FIG. 17, the indexing controller 47 determines the slack in the recording paper 3 hanging down from the paper roll 2 is less than first threshold S1. Based on this decision, the indexing controller 47 then stops rotation of the roll paper drive spindle 12 in the second direction of rotation R2 (step ST54). As a result, the indexing controller 47 stops rewinding the recording paper 3, and increases the slack.

However, while the roll paper drive spindle 12 is turning in the second direction of rotation R2, if the first photodetector 31*b* does not detect the first detection beam L1 when the first emitter 31*a* emits the first detection beam L1 (step ST53: No), the indexing controller 47 determines the slack in the recording paper 3 hanging down from the paper roll 2 is greater than or equal to first threshold S1, and continues driving the roll paper drive spindle 12.

If then the second photodetector 32*b* does not detect the second detection beam L2 when the second emitter 32*a* emits the second detection beam L2 (step ST55: No), as shown in FIG. 16, the indexing controller 47 determines the slack in the recording paper 3 hanging down from the paper roll 2 exceeds the second threshold S2. Based on this decision, the indexing controller 47 drives the roll paper drive spindle 12 in the second direction of rotation R2 (step ST56). The indexing controller 47 thereby rewinds the recording paper 3 onto the paper roll 2, and suppresses slack.

However, if the second photodetector 32*b* detects the second detection beam L2 when the second emitter 32*a* emits the second detection beam L2, the indexing controller 47 maintains the current state of the roll paper drive spindle 12. More specifically, if driving the roll paper drive spindle 12 is stopped in step ST54, the amount of slack is appropriate and the roll paper drive spindle 12 remains stopped. However, if in step ST53 the first photodetector 31*b* has not detected the first detection beam L1 (step ST53: No), the indexing controller 47 determines there is not enough slack in the recording paper 3 hanging down from the paper roll 2, and continues driving the roll paper drive spindle 12.

When the recording paper 3 has been conveyed the specific conveyance distance (step ST52: Yes), and the conveyance mechanism 21 stops (step ST57), the target start-printing position on the recording paper 3 is at the printing position A. As a result, the positioning operation ends. Note that if the roll paper drive spindle 12 is operating when the positioning operation ends, the indexing controller 47 stops the roll paper drive spindle 12 in conjunction with stopping the conveyance mechanism 21.

The slack adjustment operation then starts. In the slack adjustment operation, if the second photodetector 32*b* does not detect the second detection beam L2 when the second emitter 32*a* emits the second detection beam L2, (step ST58: No), as shown in FIG. 18, the indexing controller 47 drives the roll paper drive spindle 12 in the second direction of rotation R2 until the second photodetector 32*b* detects the second detection beam L2 (step ST59). As a result, the indexing controller 47 takes up recording paper 3 on the paper roll 2, and reduces the amount of slack. In other words, if the second detection beam L2 of the second detector 32 is blocked by the recording paper 3, the indexing controller 47 determines there is too much slack in the recording paper 3, and drives the roll paper drive spindle 12 to take up slack in the recording paper 3.

If in the slack adjustment operation the second photodetector 32*b* detects the second detection beam L2, as shown in FIG. 19, the indexing controller 47 determines the amount of slack is appropriate, and driving the roll paper drive spindle 12 in the second direction of rotation R2 is not necessary. Based on this decision, if the roll paper drive spindle 12 is turning in the second direction of rotation R2, the indexing controller 47 stops rotation (step ST60).

Printing Operation

Figure 22:
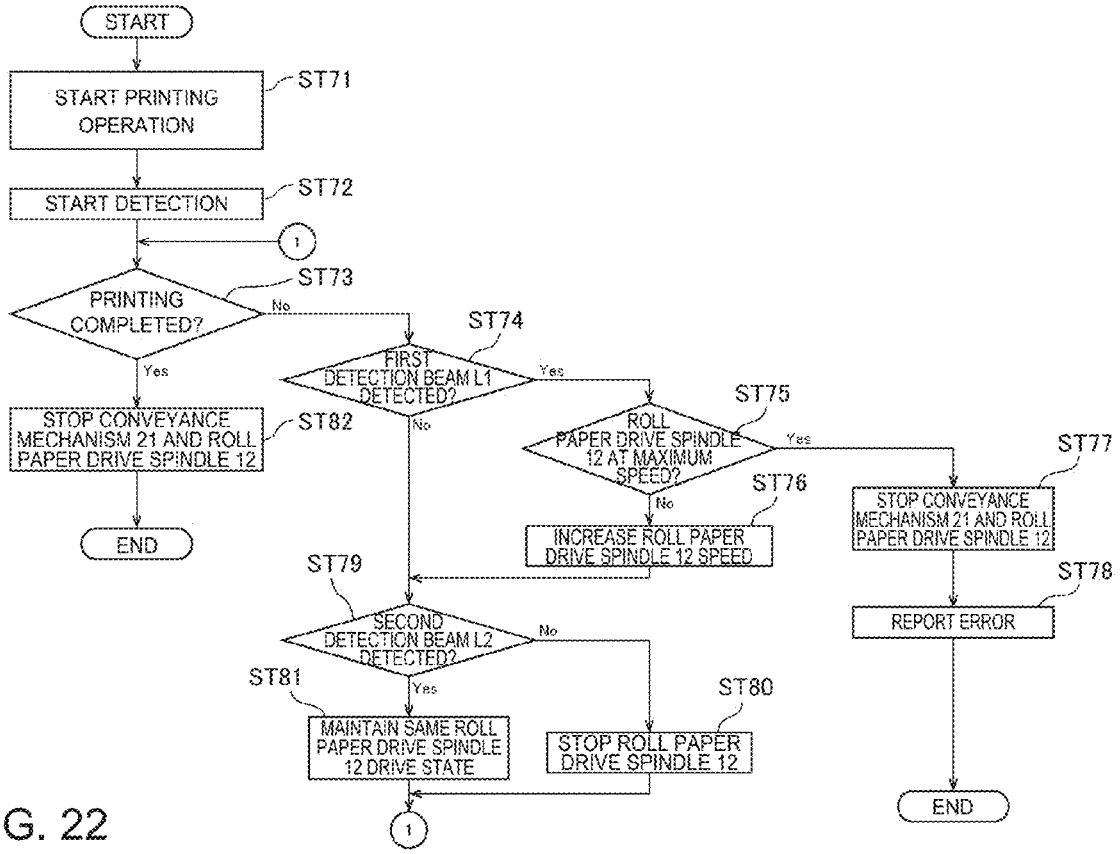
FIG. 22 is a flow chart of the printing operation.

FIG. 22 is a flow chart of the printing operation. When the indexing operation ends, the printer 1A starts the printing operation. In the printing operation, the printer 1A drives the conveyance motor 24 in the forward direction and conveys the recording paper 3 in the first direction D1. The printer 1A also drives the printhead 8 to print on the recording paper 3 passing the printing position A (step ST71). Next, the printer 1A, while executing the printing operation, executes the emitting operation (detection operation) of the first detector 31 and second detector 32 (step ST72), and controls driving the spindle drive motor 14 based on output from the first photodetector 31*b* and second photodetector 32*b*.

When the recording paper 3 is conveyed in the first direction D1 by the conveyance mechanism 21, the slack in the recording paper 3 normally decreases and the second photodetector 32*b* detects the second detection beam L2 when the second emitter 32*a* emits the second detection beam L2. The print controller 46 therefore determines driving the roll paper drive spindle 12 in the first direction of rotation R1 is necessary, and based on this decision drives the spindle drive motor 14 in the forward direction to turn the roll paper drive spindle 12 in the first direction of rotation R1. As a result, the print controller 46 delivers recording paper 3 from the paper roll 2.

If the printing operation is in progress (step ST73: No), the roll paper drive spindle 12 is turning in the first direction of rotation R1, and the first photodetector 31*b* detects the first detection beam L1 when the first emitter 31*a* emits the first detection beam L1 (step ST74: Yes), as shown in FIG. 14, the print controller 46 determines the slack in the recording paper 3 hanging down from the paper roll 2 is less than first threshold S1. Next, based on this decision, the print controller 46 increases the speed of the roll paper drive spindle 12, which is turning in the first direction of rotation R1, one step (step ST75: Yes, step ST76). As a result, the print controller 46 increases the delivery amount of recording paper 3 from the paper roll 2, and assures sufficient slack. If at this time the first photodetector 31*b* detects the first detection beam L1, and the speed of the roll paper drive spindle 12 is the maximum speed (step ST75: Yes), the print controller 46 stops the conveyance mechanism 21 and roll paper drive spindle 12, and reports an error (step ST77, step ST78).

However, if the roll paper drive spindle 12 is turning in the first direction of rotation R1, and the first photodetector 31*b* does not detect the first detection beam L1 when the first emitter 31*a* emits the first detection beam L1 (step ST74: No), the print controller 46 continues driving the roll paper drive spindle 12.

If the second photodetector 32*b* then does not detect the second detection beam L2 when the second emitter 32*a* emits the second detection beam L2 (step ST79: No), as shown in FIG. 15, the print controller 46 determines the slack in the recording paper 3 hanging down from the paper roll 2 exceeds the second threshold S2. Therefore, the print controller 46, based on this decision, stops rotation of the roll paper drive spindle 12 in the first direction of rotation R1 (step ST80). As a result, the print controller 46 stops delivering recording paper 3 from the paper roll 2, and suppresses slack in the recording paper 3.

However, if second photodetector 32*b* detects the second detection beam L2 when the second emitter 32*a* emits the second detection beam L2 (step ST79: Yes), the slack in the recording paper 3 hanging down from the paper roll 2 is less than the second threshold S2, and the roll paper drive spindle 12 continues driving in the first direction of rotation R1 (step ST81).

When the printing operation then ends (step ST73: Yes), the print controller 46 stops the conveyance mechanism 21. When the print controller 46 stops the conveyance mechanism 21, the roll paper drive spindle 12 also stops (step ST82).

Loading Operation

Figure 23:
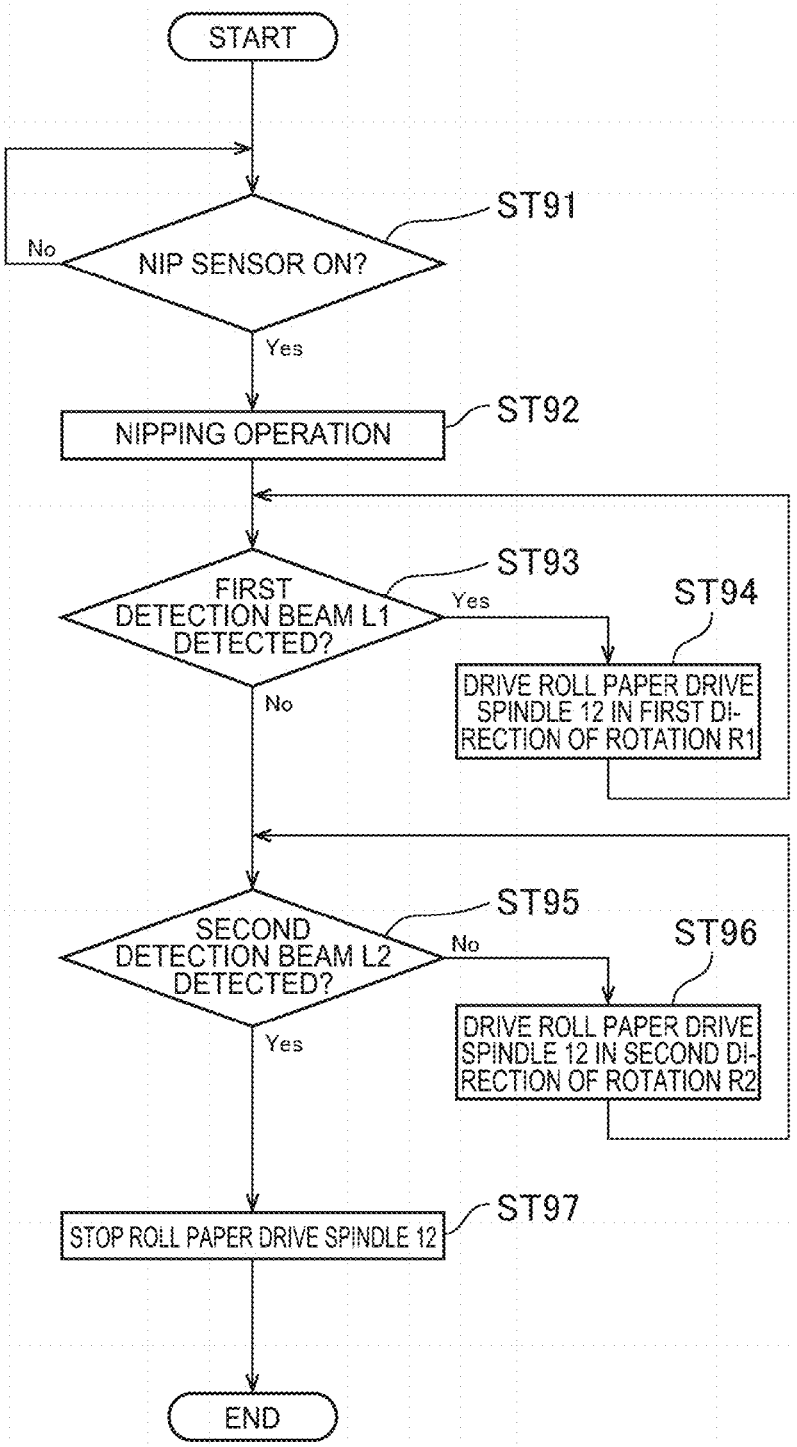
FIG. 23 is a flow chart of the loading operation.

The loading operation executed when new recording paper 3 is set in the 1*aa* is described next. FIG. 23 is a flow chart of the loading operation. When new recording paper 3 is loaded, the operator passes the recording paper 3 pulled from the paper roll 2 in the roll paper compartment 11 through the paper conveyance path 16. The operator sets the leading end of the recording paper 3 to the nip position N.

When the recording paper 3 set to the nip position N is detected by the nip sensor 26, a signal indicating that the recording paper 3 was detected is input from the nip sensor 26 to the controller 41 (step ST91: Yes), and the loading controller 48 executes the nipping operation (step ST92. More specifically, the loading controller 48, based on signal input from the nip sensor 26, drives the conveyance motor 24 in the forward direction, and conveys the recording paper 3 by the conveyance mechanism 21 a specific amount in the first direction D1. When the operator sets the recording paper 3 to the nip position N, there is generally some slack in the recording paper 3. Conveyance of the recording paper 3 by the conveyance mechanism 21 in the nipping operation is also minimal. The roll paper drive spindle 12 is therefore not driven in the nipping operation.

When the nipping operation ends, the loading controller 48 continues with the slack adjustment operation. In the slack adjustment operation, if the first photodetector 31*b* detects the first detection beam L1 when the first emitter 31*a* emits the first detection beam L1 (step ST93: Yes), the loading controller 48 determines the slack in the recording paper 3 hanging down from the paper roll 2 is less than first threshold S1 as shown in FIG. 20.

Based on this decision, the loading controller 48 drives the roll paper drive spindle 12 in the first direction of rotation R1 (step ST94). As a result, the loading controller 48 delivers recording paper 3 from the paper roll 2, and assures sufficient slack. If first photodetector 31*b* does not detect the first detection beam L1 when the first emitter 31*a* emits the first detection beam L1 (step ST93: No), the loading controller 48 determines the slack in the recording paper 3 hanging down from the paper roll 2 is greater than or equal to first threshold S1, and continues driving the roll paper drive spindle 12. More specifically, if the roll paper drive spindle 12 is being driven, the loading controller 48 continues driving, and if the roll paper drive spindle 12 is stopped, the roll paper drive spindle 12 remains stopped.

Next, if second photodetector 32*b* does not detect the second detection beam L2 when the second emitter 32*a* emits the second detection beam L2 (step ST95: No), as shown in FIG. 18, the loading controller 48 determines the slack in the recording paper 3 hanging down from the paper roll 2 exceeds the second threshold S2. Based on this decision, the loading controller 48 drives the roll paper drive spindle 12 in the second direction of rotation R2 (step ST96). As a result, the recording paper 3 is taken up on the paper roll 2, and slack is reduced.

However, if second photodetector 32*b* detects the second detection beam L2 when the second emitter 32*a* emits the second detection beam L2 (step ST95: Yes), the loading controller 48 stops the roll paper drive spindle 12 (step ST97). In other words, if driving the roll paper drive spindle 12 is stopped at this point, the loading controller 48 determines slack is sufficient and keeps the roll paper drive spindle 12 stopped. If the roll paper drive spindle 12 is being driven at this time, the loading controller 48 stops driving the roll paper drive spindle 12. Thereafter, the printer 1A waits to receive print data.

Operating Effect

This embodiment of the invention has the same effect as the printer 1 in the first embodiment. More specifically, the first emitter 31*a* and second emitter 32*a* emit alternately one at a time. The detection beam the first photodetector 31*b* detects when the first emitter 31*a* emits is therefore the first detection beam L1, and the detection beam the second photodetector 32*b* detects when the second emitter 32*a* emits is the second detection beam L2. Slack detection errors therefore do not occur even if the distance between the photodetectors 31*b*, 32*b* is short. As a result, because slack in the recording paper 3 can be accurately detected, the recording paper 3 can always be conveyed with a desirable amount of slack. Excess tension working on the recording paper 3 when conveying the recording paper 3 can therefore be prevented, and the recording paper 3 can be conveyed precisely past the printing position A. Print quality can therefore be maintained.

This example can prevent slack detection errors even if the first photodetector 31*b* is disposed to a position where the second detection beam L2 from the second emitter 32*a* can be detected, and the second photodetector 32*b* is disposed to a position where the first detection beam L1 from the first emitter 31*a* can be detected.

There is, therefore, no need to precisely adjust the photodetectors 31*b*, 32*b* to detect only the optical axis of the detection beam L1, L2 emitted by the corresponding emitter 31*a*, 32*a*. Printer 1A assembly is therefore simple.

Because the printer 1, 1A drives the roll paper drive spindle 12 in conjunction with the conveyance mechanism 21, depending upon the difference between the conveyance amount of the recording paper 3 by the conveyance mechanism 21, and the delivery amount and rewind amount of the recording paper 3 by the roll paper drive spindle 12, the amount of slack hanging down from the paper roll 2 may increase or decrease. The printer 1, 1A, using multiple detectors, precisely detects the amount of slack in the recording paper 3, and drives the roll paper drive spindle 12 based on signals from the multiple detectors. The printer 1, 1A can therefore adapt appropriately to increases and decreases in the amount of slack in the recording paper 3.

If the printer 1A according to this embodiment has a third detector 33 as in the printer 1 according to the first embodiment of the invention, the decision in step ST53 of the indexing operation in FIG. 21 can be made based on signal input from the third detector 33 instead of signal input from the first detector 31. More specifically, the decision of step ST53 can be based on whether or not the third photodetector 33*b* detects the third detection beam L3 when the third emitter 33*a* emits the third detection beam L3.

The decision of step ST74 in the printing operation in FIG. 22 can also be based on signal input from the third detector 33 instead of signal input from the first detector 31. More specifically, the decision of step ST74 can be based on whether or not the third photodetector 33*b* detects the third detection beam L3 when the third emitter 33*a* emits the third detection beam L3.

The decision of step ST92 in the loading operation in FIG. 23 can also be based on signal input from the third detector 33 instead of signal input from the first detector 31. More specifically, the decision of step ST92 can be based on whether or not the third photodetector 33*b* detects the third detection beam L3 when the third emitter 33*a* emits the third detection beam L3.

Because the amount of slack in the recording paper 3 can thus be detected with good precision, slack in the recording paper 3 can be reliably assured.

The printer 1 in the first embodiment may also be configured with the loading controller 48 of the printer 1A in the second embodiment, and perform the same loading operation.

The invention being thus described, it will be obvious that it may be varied in many ways. Such variations are not to be regarded as a departure from the spirit and scope of the invention, and all such modifications as would be obvious to one skilled in the art are intended to be included within the scope of the following claims.

This application claims priority under 35 U.S.C. §119 to Japanese Patent Application No. 2016-004169, filed Jan. 13, 2016. The entire disclosure of Japanese Patent Application No. 2016-004169 is hereby incorporated herein by reference.

What is claimed is:

1. A media conveyance device comprising:

a paper roll rotating mechanism having a spindle to support a paper roll, and configured to drive the spindle and rotate the paper roll;

a conveyance mechanism configured to convey media delivered from the paper roll;

a controller configured to control the paper roll rotating mechanism and the conveyance mechanism, and convey media delivered from the paper roll;

a first detector including a first emitter and first photodetector disposed vertically below the spindle, and outputting to the controller a signal based on the amount of light detected by the first photodetector; and a second detector including a second emitter disposed vertically below the first emitter and a second photodetector disposed vertically below the first photodetector, and outputting to the controller a signal based on the amount of light detected by the second photodetector;

the controller selectively driving the first emitter and second emitter when driving the conveyance mechanism, and driving the spindle based on signal output from the first detector when the first emitter emits, and signal output from the second detector when the second emitter emits.

2. The media conveyance device described in claim 1, wherein:

when the media is conveyed by the conveyance mechanism in the direction from the paper roll to the conveyance mechanism, the controller, based on signal output from the second detector, determines whether or not to drive the spindle in a first direction of rotation delivering the media, when slack hanging down from the paper roll is determined less than a first threshold based on the signal output from the first detector when the spindle is turning in the first direction of rotation from the paper roll based on the decision, increases the speed of the spindle in the first direction of rotation; and when slack hanging down from the paper roll is determined greater than a second threshold, at which the amount of slack in the media is greater than the first threshold, based on the signal output from the second detector when the spindle is turning in the first direction of rotation from the paper roll based on the decision, stops rotation of the spindle.

3. The media conveyance device described in claim 2, wherein:

the controller drives the conveyance mechanism to convey the media a specific amount in the direction from the paper roll to the conveyance mechanism, and then stops driving the conveyance mechanism; and drives the spindle in a second direction of rotation, which is opposite the first direction of rotation, until slack in the media is less than the second threshold based on signal output from the second detector.

4. The media conveyance device described in claim 2, further comprising:

a third detector including a third emitter located vertically between the first emitter and second emitter, and a third photodetector located vertically between the first photodetector and second photodetector;

when the media is conveyed by the conveyance mechanism in the direction from the paper roll to the conveyance mechanism, the controller controls rotation of the spindle in the first direction of rotation based on signal output from the first detector and signal output from the second detector; and when the media is conveyed by the conveyance mechanism in the direction from the conveyance mechanism to the paper roll, the controller controls rotation of the spindle in the second direction of rotation, which is opposite the first direction of rotation, based on signal output from the third detector.

5. The media conveyance device described in claim 1, wherein:

when the media is conveyed by the conveyance mechanism in the direction from the conveyance mechanism to the paper roll, the controller, based on the signal output from the second detector, determines whether or not to rotate the spindle in a second direction of rotation rewinding the media; and when the spindle is rotating in the second direction of rotation based on the decision, and the slack hanging down from the paper roll is determined less than a first threshold based on the signal output from the first detector, stops rotation of the spindle in the second direction of rotation.

6. A printer comprising:

the media conveyance device described in claim 1;

a printhead; and a conveyance path passing the printing position of the printhead;

the media conveyance device conveying the media through the conveyance path.

7. A control method of a media conveyance device, the media conveyance device including a paper roll rotating mechanism having a spindle to support a paper roll, and configured to drive the spindle and rotate the paper roll;

a conveyance mechanism configured to convey media delivered from the paper roll; and a first detector including a first emitter and first photodetector disposed vertically below the spindle, and outputting a signal based on the amount of light detected by the first photodetector; and a second detector including a second emitter disposed vertically below the first emitter and a second photodetector disposed vertically below the first photodetector, and outputting a signal based on the amount of light detected by the second photodetector;

the control method comprising:

selectively driving the first emitter and second emitter while driving the conveyance mechanism and conveying the media; and driving the spindle based on signal output from the first detector when the first emitter emits, and signal output from the second detector when the second emitter emits.

8. The control method of a media conveyance device described in claim 7, further comprising:

driving the conveyance mechanism and conveying the media in the direction from the paper roll to the conveyance mechanism;

determining, based on signal output from the second detector, whether or not to drive the spindle in a first direction of rotation delivering the media;

while driving the spindle in the first direction of rotation based on the decision, increasing the speed of the spindle in the first direction of rotation when slack hanging down from the paper roll is determined less than a first threshold based on the signal output from the first detector; and stopping rotation of the spindle when slack hanging down from the paper roll is determined, based on the signal output from the second detector, greater than a second threshold, at which the amount of slack in the media is greater than the first threshold.

9. The control method of a media conveyance device described in claim 8, further comprising:

driving the conveyance mechanism to convey the media a specific amount in the direction from the paper roll to the conveyance mechanism, and then stopping driving the conveyance mechanism; and driving the spindle in a second direction of rotation, which is opposite the first direction of rotation, until slack in the media is less than the second threshold based on signal output from the second detector.

10. The control method of a media conveyance device described in claim 8, the media conveyance device including a third detector including a third emitter located vertically between the first emitter and second emitter, and a third photodetector located vertically between the first photodetector and second photodetector, the control method further comprising:

driving the conveyance mechanism and conveying the media in the direction from the paper roll to the conveyance mechanism; and controlling rotation of the spindle in the first direction of rotation based on signal output from the first detector and signal output from the second detector; and based on signal output from the third detector, controlling rotation of the spindle in the second direction of rotation, which is opposite the first direction of rotation.

11. The control method of a media conveyance device described in claim 7, further comprising:

driving the conveyance mechanism and conveying the media in the direction from the paper roll to the conveyance mechanism;

determining, based on the signal output from the second detector, whether or not to rotate the spindle in a second direction of rotation rewinding the media; and when the spindle is rotating in the second direction of rotation based on the decision, and the slack hanging down from the paper roll is determined less than a first threshold based on the signal output from the first detector, stopping rotation of the spindle in the second direction of rotation.

* * * * *